US008011281B2

(12) United States Patent
Hidaka et al.

(10) Patent No.: US 8,011,281 B2
(45) Date of Patent: Sep. 6, 2011

(54) PUNCHING DEVICE, CONVEYING DEVICE, FINISHING DEVICE, AND IMAGE FORMING APPARATUS

(75) Inventors: Makoto Hidaka, Tokyo (JP); Akira Kunieda, Tokyo (JP); Junichi Tokita, Kanagawa (JP); Hitoshi Hattori, Tokyo (JP); Ichiro Ichihashi, Aichi (JP); Kazuhiro Kobayashi, Kanagawa (JP); Masahiro Tamura, Kanagawa (JP); Tomoichi Nomura, Aichi (JP); Hiroshi Maeda, Aichi (JP); Nobuyoshi Suzuki, Tokyo (JP); Tomohiro Furuhashi, Kanagawa (JP); Shuuya Nagasako, Kanagawa (JP); Naohiro Kikkawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 531 days.

(21) Appl. No.: 12/073,942

(22) Filed: Mar. 12, 2008

(65) Prior Publication Data

US 2008/0236351 A1 Oct. 2, 2008

(30) Foreign Application Priority Data

Mar. 14, 2007 (JP) ..... 2007-065342

(51) Int. Cl.
*G03G 15/00* (2006.01)

(52) U.S. Cl. ..... 83/74; 83/76.8; 83/240; 399/407; 700/192

(58) Field of Classification Search ..... 83/74–75.5, 83/76.6–76.8, 198, 209–211, 240, 268; 700/176, 700/192; 399/394, 395, 405, 407; 400/621; 270/58.07; *B65H 35/00*

See application file for complete search history.

(56) References Cited

U.S. PATENT DOCUMENTS

| | | | | |
|---|---|---|---|---|
| 6,065,383 | A * | 5/2000 | Takaishi et al. | 83/368 |
| 6,353,726 | B1 * | 3/2002 | Murata et al. | 399/407 |
| 6,386,080 | B1 * | 5/2002 | Okamoto et al. | 83/73 |
| 6,511,239 | B1 * | 1/2003 | Kretschmann et al. | 400/579 |
| 6,783,124 | B2 * | 8/2004 | Tamura et al. | 270/58.07 |
| 6,907,806 | B1 * | 6/2005 | Okamoto et al. | 83/76.8 |
| 7,520,498 | B2 * | 4/2009 | Hattori et al. | 270/58.07 |
| 2002/0012549 | A1 * | 1/2002 | Oku | 399/167 |
| 2005/0175383 | A1 * | 8/2005 | Howe | 399/395 |

(Continued)

FOREIGN PATENT DOCUMENTS

JP 10-194557 * 7/1998

(Continued)

OTHER PUBLICATIONS

Applicants enclose an English Language Abstract of Japanese Patent Publication No. JP 04-009883 dated Jan. 14, 1992.

(Continued)

*Primary Examiner* — Edward Landrum

(74) *Attorney, Agent, or Firm* — Harness, Dickey & Pierce, P.L.C.

(57) ABSTRACT

A punching device includes a detecting unit, a punching unit, a moving unit, a storage unit, and a controlling unit. The detecting unit detects a lateral edge position of a recording medium to obtain edge position data. When the edge position data does not indicate an error value, the edge position data is stored in the storage unit as reference data. The controlling unit determines, when the edge position data indicates an error value, a movement amount of the punching unit based on reference data previously obtained and stored in the storage unit. The moving unit moves the punching unit by the movement amount in a direction perpendicular to the conveying direction of the recording medium.

17 Claims, 28 Drawing Sheets

L: DISTANCE DETECTED BY LATERAL REGISTRATION SENSOR
M: THEORETICAL REGISTRATION POSITION
x: MISALIGNMENT AMOUNT (M−L)

MOVEMENT AMOUNT FROM HOME POSITION OF PUNCHING UNIT=7.5mm−x

U.S. PATENT DOCUMENTS

| | | | |
|---|---|---|---|
| 2006/0261544 | A1 | 11/2006 | Tamura et al. |
| 2007/0235917 | A1 | 10/2007 | Nagasako et al. |

FOREIGN PATENT DOCUMENTS

| | | |
|---|---|---|
| JP | 2900510 | 3/1999 |
| JP | 2001-119576 | 4/2001 |
| JP | 3363725 | 10/2002 |
| JP | 2003-206068 | 7/2003 |
| JP | 2004-217348 | 8/2004 |
| JP | 2006-016129 | 1/2006 |
| JP | 2006-082936 | 3/2006 |
| JP | 2006-160518 | 6/2006 |

OTHER PUBLICATIONS

Applicants enclose an English Language Abstract of Japanese Patent Publication No. JP 10-194557 dated Jul. 28, 1998.

Office Action for corresponding Japanese patent application No. 2007-065342 dated Mar. 22, 2011.

* cited by examiner

L: DISTANCE DETECTED BY LATERAL REGISTRATION SENSOR
M: THEORETICAL REGISTRATION POSITION
x: MISALIGNMENT AMOUNT (M-L)

MOVEMENT AMOUNT FROM HOME POSITION OF PUNCHING UNIT=7.5mm-x

PUNCHING DEVICE, CONVEYING DEVICE, FINISHING DEVICE, AND IMAGE FORMING APPARATUS

CROSS-REFERENCE TO RELATED APPLICATIONS

The present application claims priority to and incorporates by reference the entire contents of Japanese priority document 2007-065342 filed in Japan on Mar. 14, 2007.

BACKGROUND OF THE INVENTION

1. Field of the Invention

The present invention relates to a punching device, a conveying device, a finishing device, and an image forming apparatus.

2. Description of the Related Art

For example, Japanese Patent Application Laid-open No. 2006-082936 discloses a conventional technology in which a punching device includes a sheet conveying unit that conveys a sheet and a punching unit that punches the sheet that has been conveyed by the conveying unit. The punching device also includes a branching unit, which branches a conveying path to a first and a second conveying paths, at a downstream of the punching unit. Japanese Patent Application Laid-open No. 2006-160518 discloses another conventional technology in which a punching device offsets a waiting position, which is in a direction perpendicular to a sheet conveying direction of a punching unit, by a predetermined distance from a position at which the punching unit performs a punching relative to the sheet, and the punching unit starts a punching preparation motion from the waiting position after a leading end of the sheet passes through.

In both the conventional technology, lateral registration is detected by a plurality of sensors, and a punching position is changed depending on the detection result to improve accuracy of the punching position.

Specifically, a side edge (lateral registration) of a sheet is detected by a charge coupled device (CCD) line sensor (lateral-registration detection sensor) to control movement of a punching unit depending on a misalignment amount of detected sheet edge to improve the accuracy of the punching position. At this time, the CCD line sensor may not detect an end surface due to a type of the sheet (e.g., a color and a difference in a reflection ratio of a printed image). In this case, especially when a print in black is performed, the end surface cannot be detected. This is generally regarded as an error and the process is terminated, or punching is performed even if the misalignment amount is in a range regarded as an error.

SUMMARY OF THE INVENTION

It is an object of the present invention to at least partially solve the problems in the conventional technology.

According to an aspect of the present invention, there is provided a punching device including a conveying unit that conveys a recording medium; a detecting unit that detects a lateral edge position of the recording medium to obtain edge position data; a punching unit that punches the recording medium; a moving unit that moves the punching unit in a direction perpendicular to a conveying direction in which the recording medium is conveyed; a storage unit that stores therein edge position data obtained by the detecting unit as reference data; and a controlling unit that determines, when the edge position data obtained from the recording medium by the detecting unit indicates an error value, a movement amount of the punching unit based on the reference data stored in the storage unit.

According to another aspect of the present invention, there is provided an image forming apparatus that includes a punching device including a conveying unit that conveys a recording medium; a detecting unit that detects a lateral edge position of the recording medium to obtain edge position data; a punching unit that punches the recording medium; and a moving unit that moves the punching unit in a direction perpendicular to a conveying direction in which the recording medium is conveyed. The image forming apparatus further includes a storage unit that stores therein edge position data obtained by the detecting unit as reference data; and a controlling unit that determines, when the edge position data obtained from the recording medium by the detecting unit indicates an error value, a movement amount of the punching unit based on the reference data stored in the storage unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
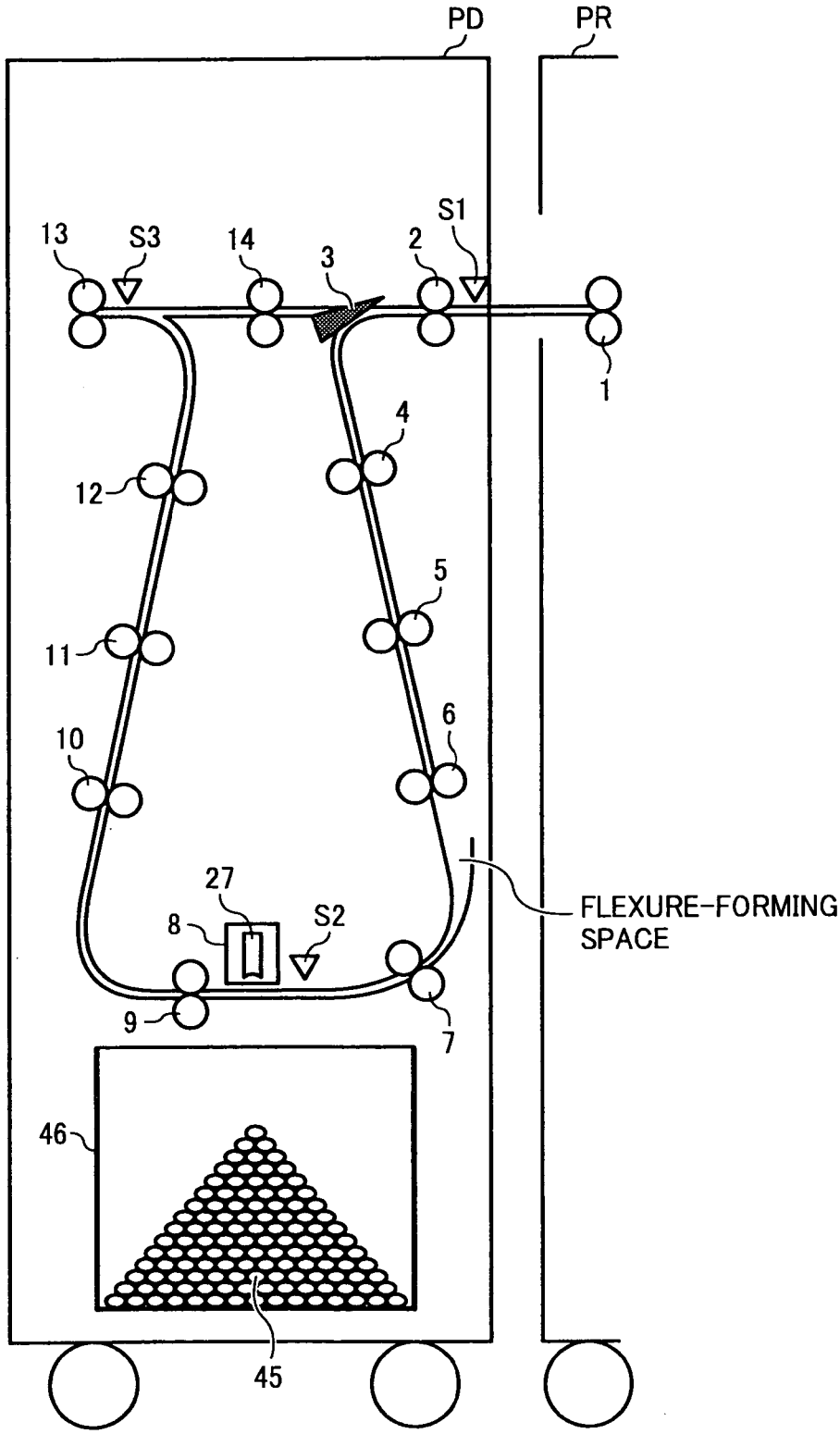
FIG. 1 is a schematic diagram of a finishing device as an image processing apparatus according to an embodiment of the present invention.

FIG. 1 is a schematic diagram of a finishing device PD as an image processing apparatus according to an embodiment of the present invention. Explained below is the configuration and operation of the finishing device PD.

A recording medium (sheet) such as a transfer sheet and an overhead projector (OHP) sheet, which a sheet-eject roller 1 of an image forming apparatus PR has ejected, is conveyed into the finishing device PD via an inlet sensor S1. At an inlet section of the finishing device PD are arranged the inlet sensor S1 and an inlet roller 2. The sheet, which has been conveyed into the finishing device PD, passes through the inlet sensor S1 to the inlet roller 2. Subsequently, when punching is not performed, the sheet passes through a branch nail 3 while conveyed in a straight manner, and passes through a horizontal roller 14 and a sheet-eject roller 13 to be ejected to a finishing device located at a downstream.

When the punching is performed, the sheet passes through an underside of the branch nail 3 to be conveyed to vertical conveying rollers 4, 5, and 6. A direct current (DC) solenoid or a stepping motor, both of which are not shown, performs a switchover of the branch nail 3. When a leading end of the sheet butts against a registration roller 7 (in a resting state) that is placed at the downstream of the vertical conveying roller 6, and accordingly, a flexure having an adequate amount is formed, a skew of the leading end of the sheet is corrected. The flexure is formed in a flexure-forming space shown in FIG. 1. Pressing a flexure section by use of an elastic deformation member increases an impellent force at the leading end of the sheet, whereby the skew correction is performed with more accuracy.

A setting of the flexure amount is managed using the number of pulses from the time when the inlet sensor S1 detects the leading end of the sheet, and determines a conveying amount or the like from the time when the leading end of the sheet butts against the registration roller 7 (in a resting state). A default of the flexure amount has been set as 5 millimeters. However, the flexure amount can be changed through the setting by a service man. Therefore, when the sheet is thin and has a weak body strength, and accordingly, it is hard to perform the skew correction relative to the sheet, it is possible to perform the setting such as an increase of the flexure amount. During the time when the flexure is being formed, the vertical conveying rollers 4 to 6 (when the sheet is a longitudinal sheet, the inlet roller 2 is also included), which have been nipping the sheets at an upstream of the registration roller 7, keep stopping. When a predetermined flexure amount is formed, the registration roller 7 and the conveying rollers, which have been nipping the sheet at the upstream of the registration roller 7, start rotating at the same time, and then, speed up to a linear speed that is faster than a receiving linear speed to save time between sheets.

Because a distance between the registration roller 7 and the body sheet-eject roller 1 is longer than a maximum sheet size where the skew correction is performed (a punch is performed), the sheet can butt against the registration roller 7 in a state where the sheet has been perfectly ejected from the body. As described above, because the body sheet-eject roller 1 has not nipped the sheet during the skew correction, the flexure amount does not continue to increase by means of the body sheet-eject roller 1, which continues to rotate, until the registration roller 7 starts to rotate to become the same linear speed as the body. Because the flexure amount does not become excessive, the sheet does not suffer damage, such as a wrinkle or a fold.

Figure 2:
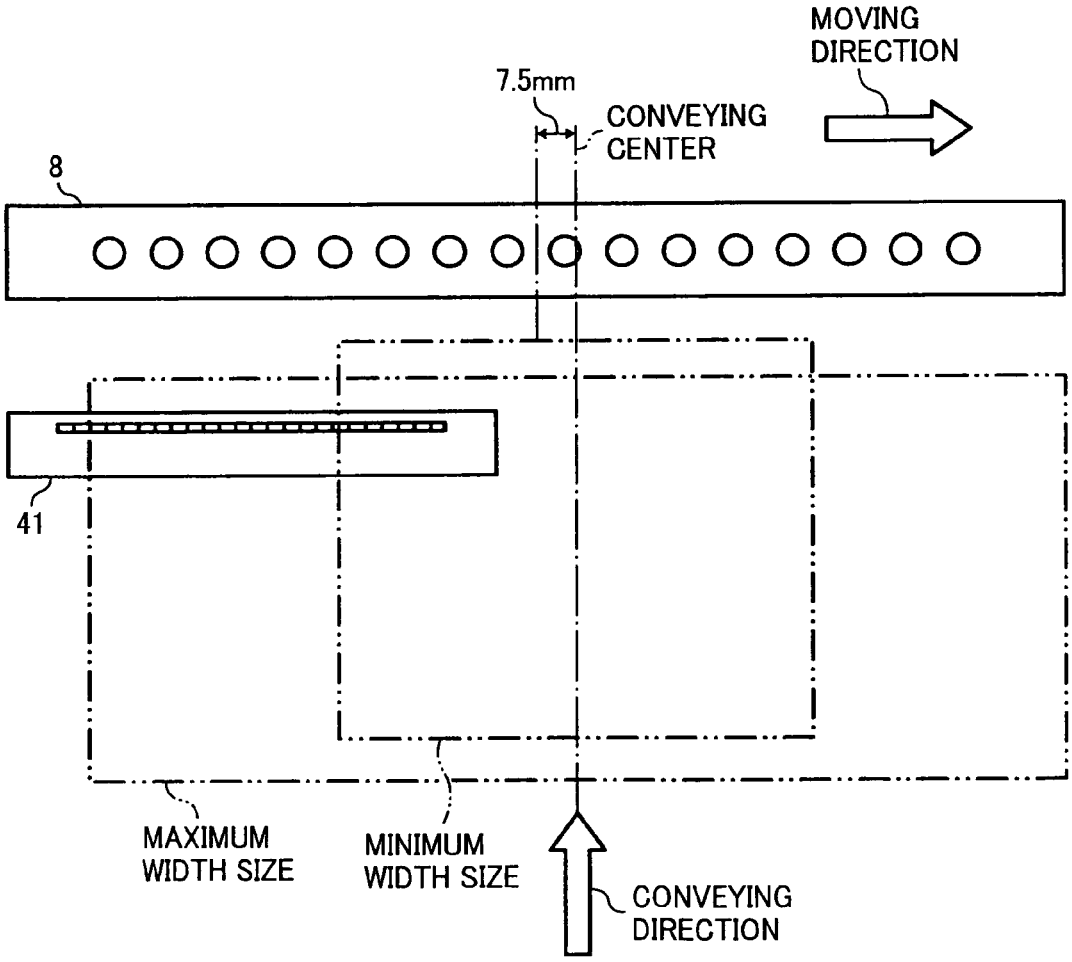
FIG. 2 is a plan view of a punching unit shown in FIG. 1 for explaining a relationship between the punching unit and a sheet size.

FIG. 2 is a plan view of the punching unit 8 for explaining a relationship between the punching unit 8 and the sheet size. The sheet subjected to the skew correction passes through the lateral registration sensor S2. In FIG. 2, a charge coupled device (CCD) line sensor 41 is employed as the lateral registration sensor S2. The CCD line sensor 41 is configured to cover a range from a minimum width size to a maximum width size of the sheet, and to be capable of detecting a side edge of the sheet. Naturally, the CCD line sensor 41 can detect the sheets even in a state where the sheets have been misaligned widthwise up to ±7.5 millimeters without any problems.

The punching unit 8 is moved in a sliding manner by a difference between a position of the side edge of the sheet that the lateral registration sensor S2 has detected and a position to which the sheet has been ideally conveyed in a direction perpendicular to a conveying direction. The punching unit 8 waits at a position where the punching unit 8 has moved toward a near side (a far side may also be applicable) relative to a conveying center position by an estimated maximum lateral registration misalignment amount (set to 7.5 millimeters). If the sheet is conveyed in a state with no misalignment of the lateral registration, the punching unit 8 moves in a sliding manner by 7.5 millimeters to punch the sheet. If the sheet is conveyed in a state to be misaligned by 2 millimeters toward the near side, the punching unit 8 moves by 5.5 millimeters in a sliding manner to punch the sheet. It is desirable to have completed the sliding movement of the punching unit 8 immediately before the sheet stops at a predetermined punching location. That is, if the punching unit 8 is in the middle of sliding although the sheet has stopped, the punching unit 8 becomes in a state not to be capable of punching the sheet, thereby reducing productivity. If the sliding movement has been completed too much before the sheet stops, the lateral registration sensor S2 is determined to have performed a detection too early, thereby worsening a detection accuracy of the lateral registration.

Figure 3:
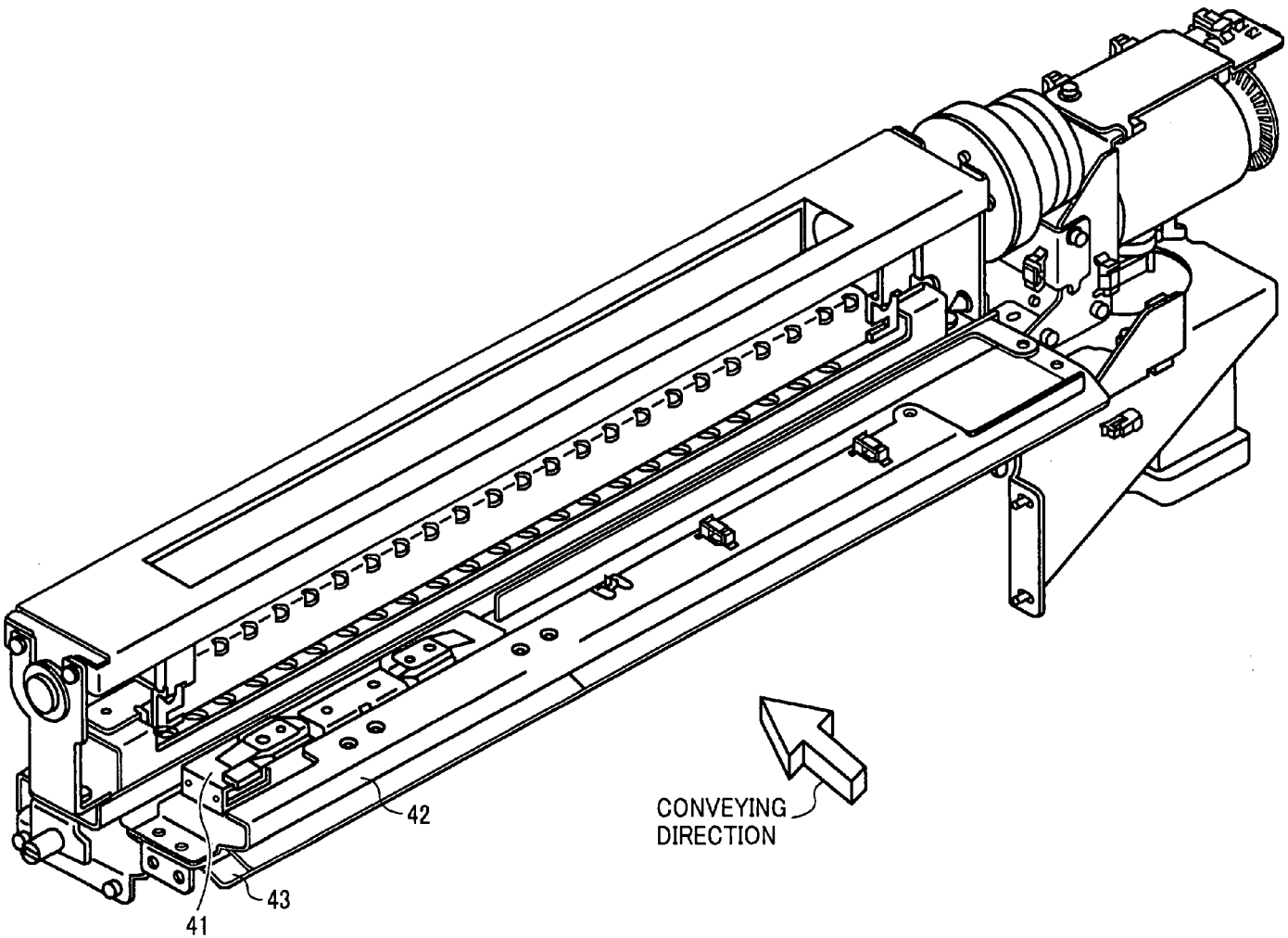
FIG. 3 is a perspective view of the punching unit for explaining a relationship between the punching unit and a lateral registration sensor shown in FIG. 1.

FIG. 3 is a perspective view of the punching unit 8 for explaining a relationship between the punching unit 8 and the lateral registration sensor S2. As shown in FIG. 3, with regard to a positional relationship between the punching unit 8 and the lateral registration sensor S2, the lateral registration sensor S2 is located at the upstream of the punching unit 8. FIG. 3 depicts a before-punch upper guide plate 42, and a before-punch lower guide plate 43. The CCD line sensor 41 (lateral registration sensor S2) is mounted onto the before-punch upper guide plate 42. After the punching, a conveying speed of the sheet is increased again to prevent from colliding against the next sheet to be conveyed to the after-punch conveying roller 9, the vertical conveying rollers 10, 11, and 12, in this order. Finally, the sheet is transferred to the apparatus located at the downstream by means of the sheet-eject roller 13. A sheet-eject sensor S3 is provided at the upstream of the sheet-eject roller 13.

Figure 4:
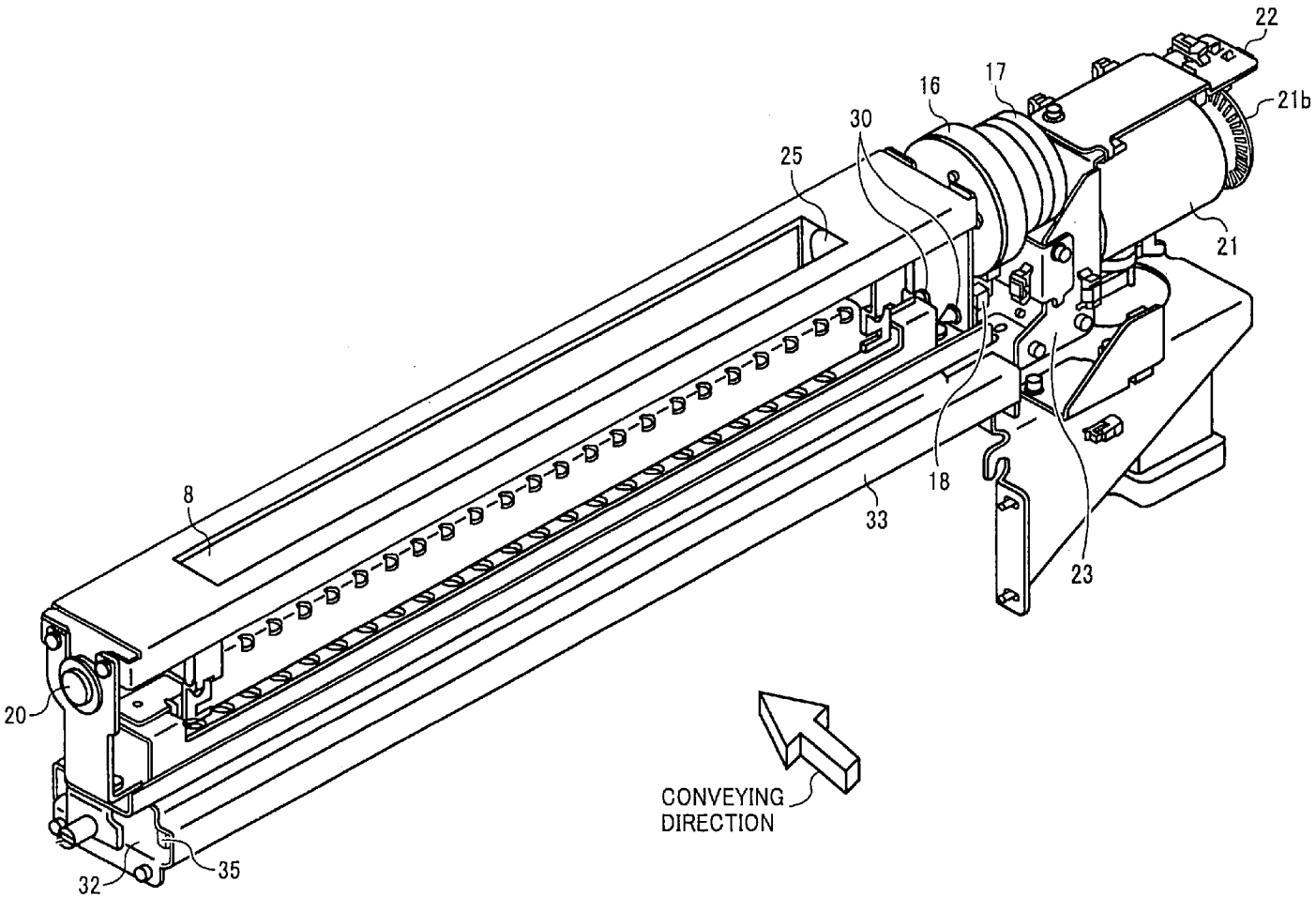
FIG. 4 is a perspective view of the punching unit.
Figure 5:
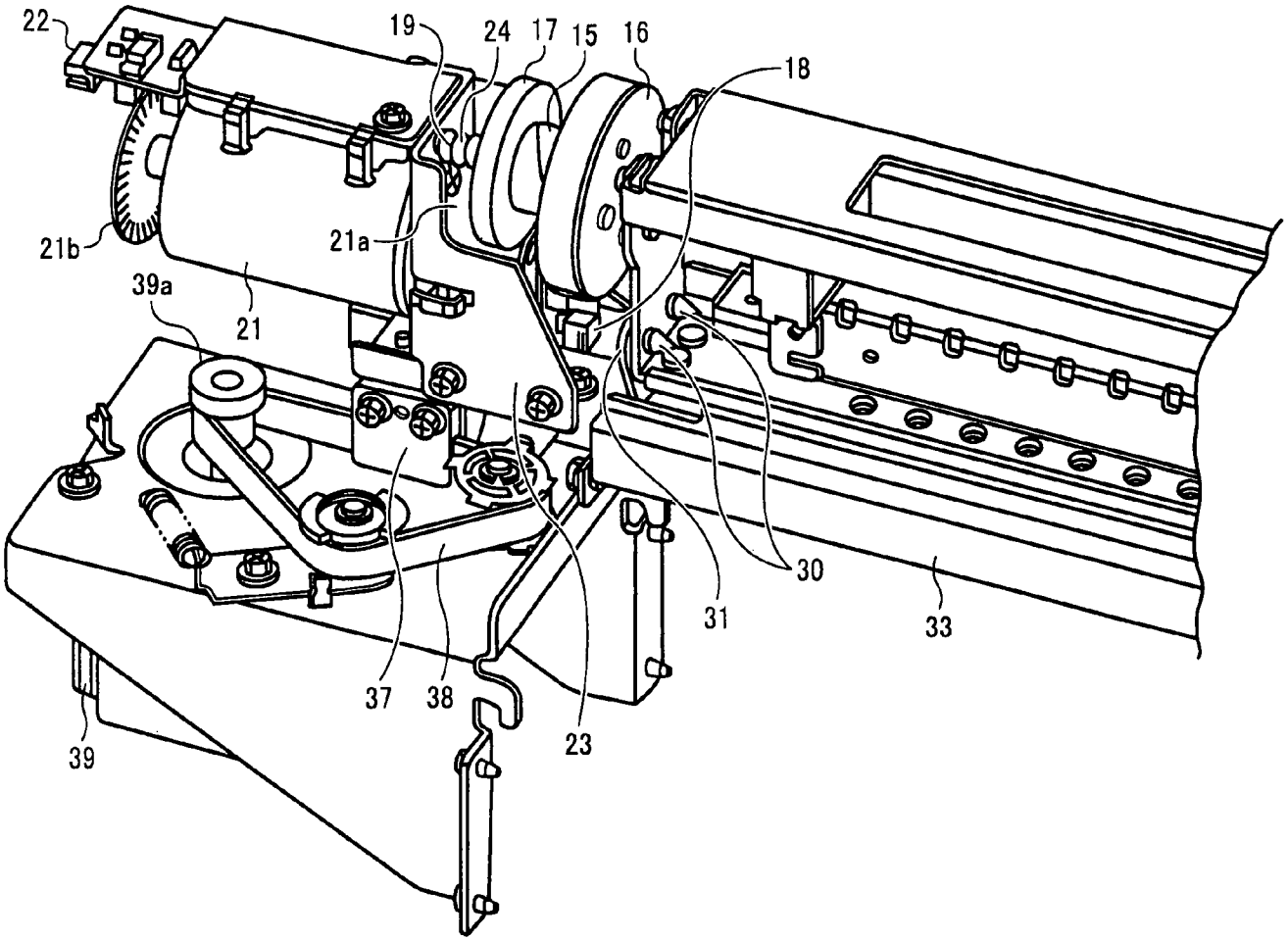
FIG. 5 is a perspective view of relevant part of the punching unit viewed from the rear of a motor-arranged side.
Figure 6:
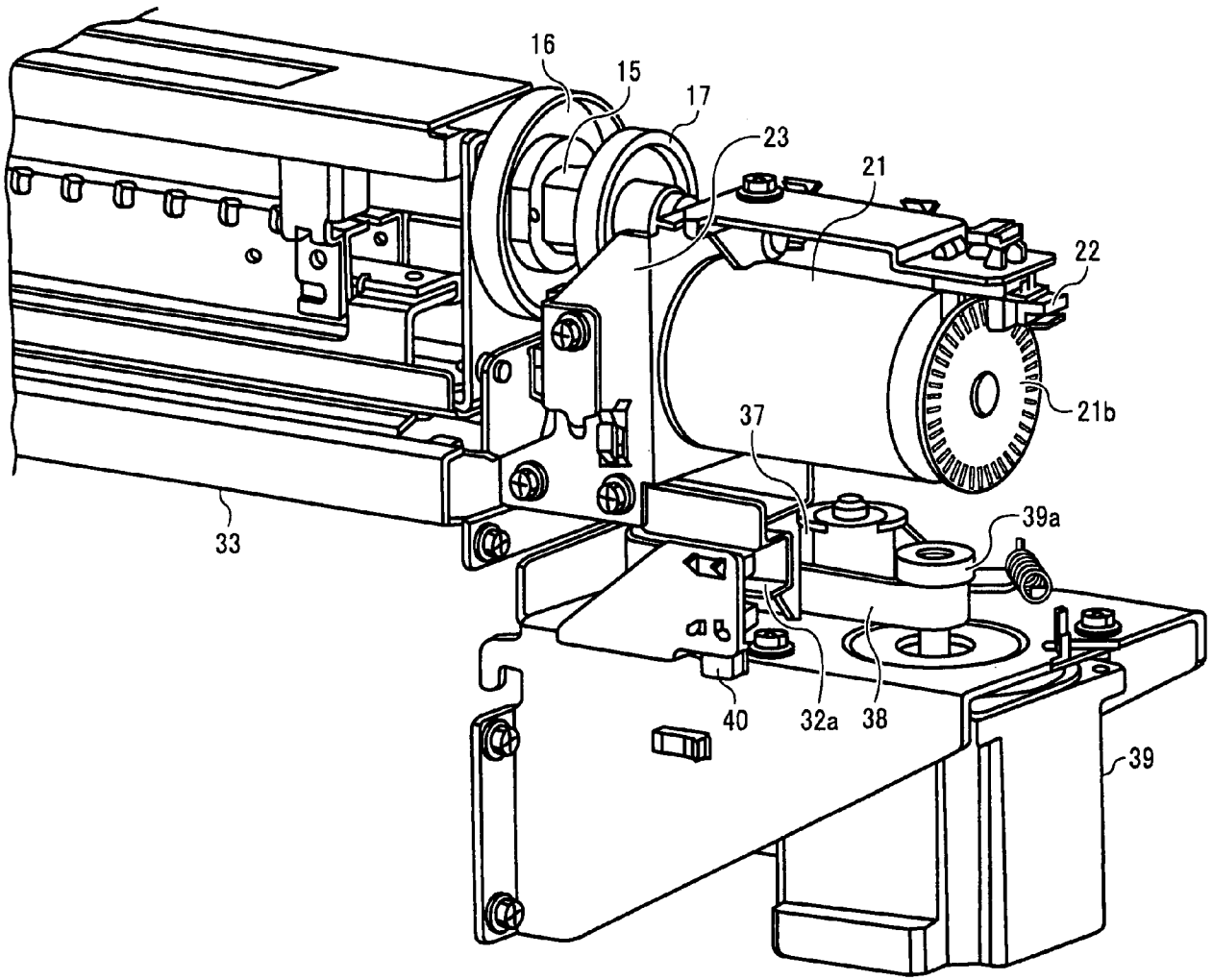
FIG. 6 is a perspective view of relevant part of the punching unit viewed from the front of the motor-arranged side.
Figure 7:
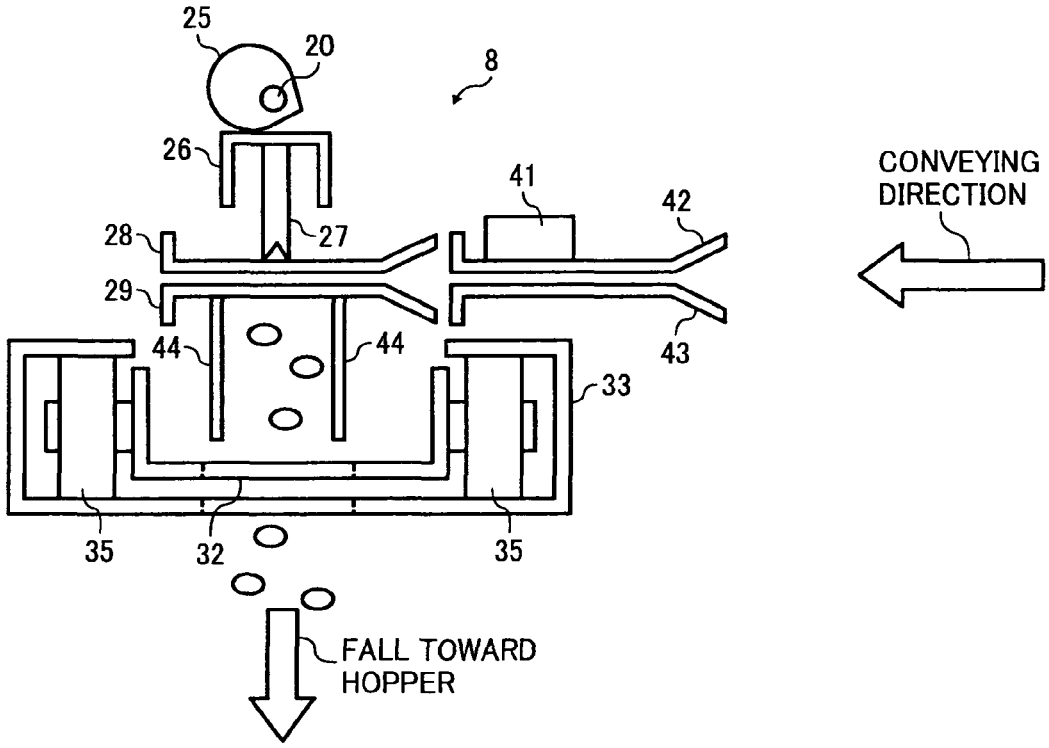
FIG. 7 is a schematic diagram for explaining motion of the punching unit at the time of punching.

Explained below is a sliding mechanism of the punching unit 8. FIG. 4 is a perspective view of the punching unit 8. FIG. 5 is a perspective view of relevant part of the punching unit 8 viewed from the rear of a motor-arranged side. FIG. 6 is a perspective view of relevant part of the punching unit 8 viewed from the front of the motor-arranged side. FIG. 7 is a schematic diagram for explaining motion of the punching unit 8 at the time of the punching.

As described above, according to the embodiment, the punching unit 8 is moved by the difference between the position of the side edge of the sheet that the lateral registration sensor S2 has detected and the position to which the sheet has been ideally conveyed in a direction perpendicular to the conveying direction, whereby accuracy of a punch position is improved. The punching unit 8 is fixed onto a base 32 by use of a docking pin 30 and a finger screw 36. The docking pin 30 is integrated into a pin bracket 31 to be fixed onto the base 32. As shown in FIG. 7, the base 32 has rollers 35 at four positions back and forth and around. The rollers 35 roll in a squared U-shaped stay 33, whereby the punching unit 8 slides in a direction perpendicular to the conveying direction of the sheet. As a guide when the punching unit 8 slides, a guide pin 34 (FIGS. 15, 16) is upwardly provided in a standing manner on an upper surface of the base 32 at both ends in a longitudinal direction of the base.

With regard to a drive of the punching unit 8, the fixing plate 37 fixes a timing belt 38, which is rotated via the stepping motor 39 and the stepping motor pulley 39A, and the base 32, and then, a positive rotation and a reverse rotation of the stepping motor 39 drives the timing belt 38, whereby the punching unit 8 is driven. A sliding motion amount is managed by use of a pulse count. Smaller a movement amount per one pulse becomes, more minutely a position correction can be performed.

As shown in FIG. 6, the detection of a home position of the punching unit 8 is performed through the detection of an edge of a blocking plate 32A that is one portion of a shape of the base 32. As described above, the punching unit 8 waits at the position where the punching unit 8 has moved toward the near side (the far side may also be applicable) relative to the conveying center position shown in FIG. 2 by the estimated maximum lateral registration misalignment amount (set to 7.5 millimeters). This position is just the position where the home sensor 40 has been detecting the edge of the blocking plate 32A.

Figure 8:
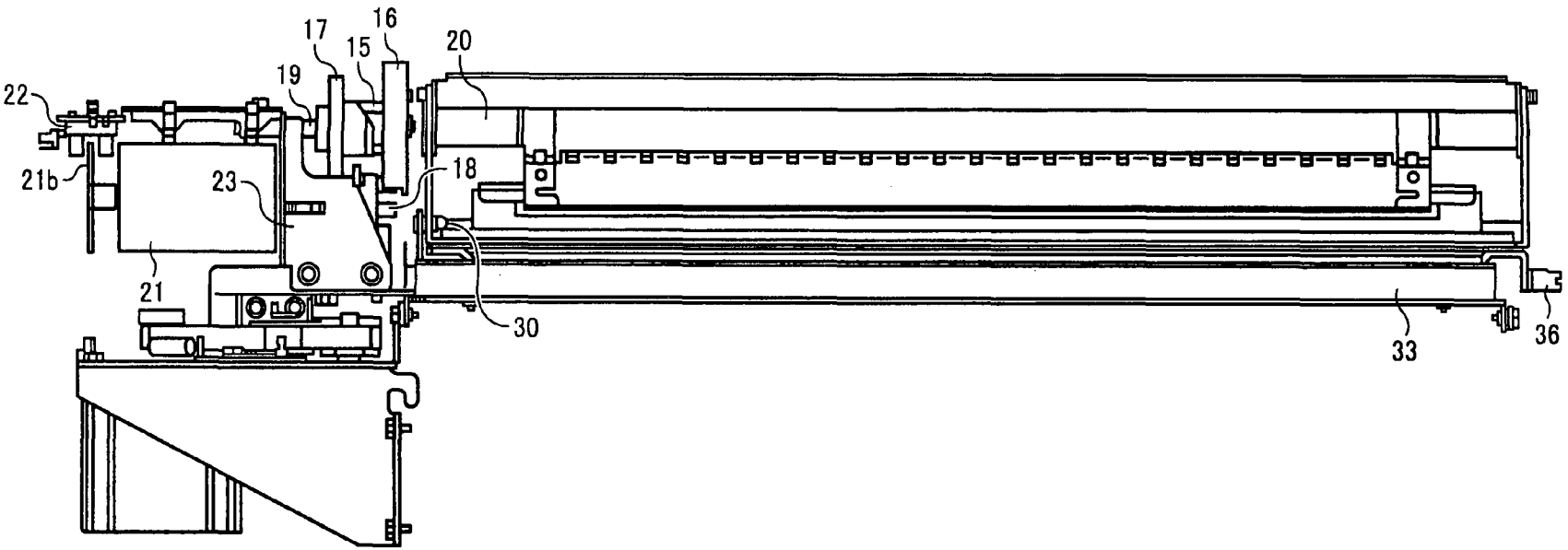
FIG. 8 is a rear view of the punching unit.
Figure 9A:
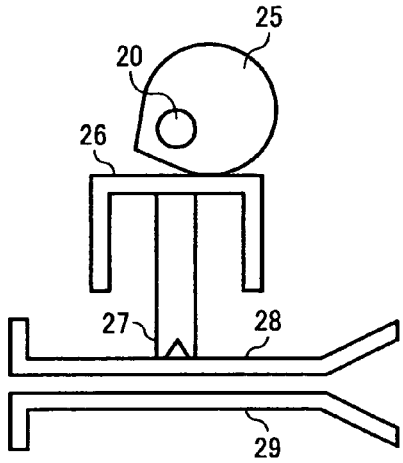
FIGS. 9A, 9B, and 9C are schematic diagrams for explaining up-and-down motion of the punching unit at the time of the punching.
Figure 9B:
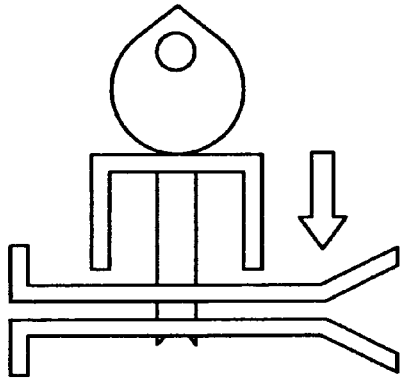
Figure 9C:
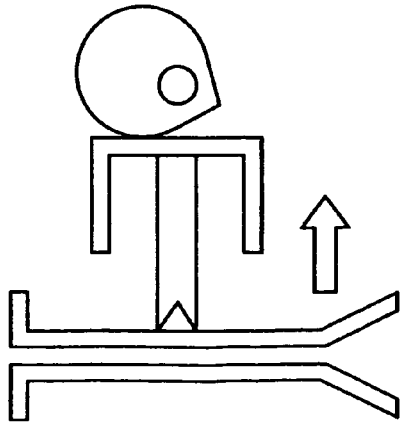
Figure 10:
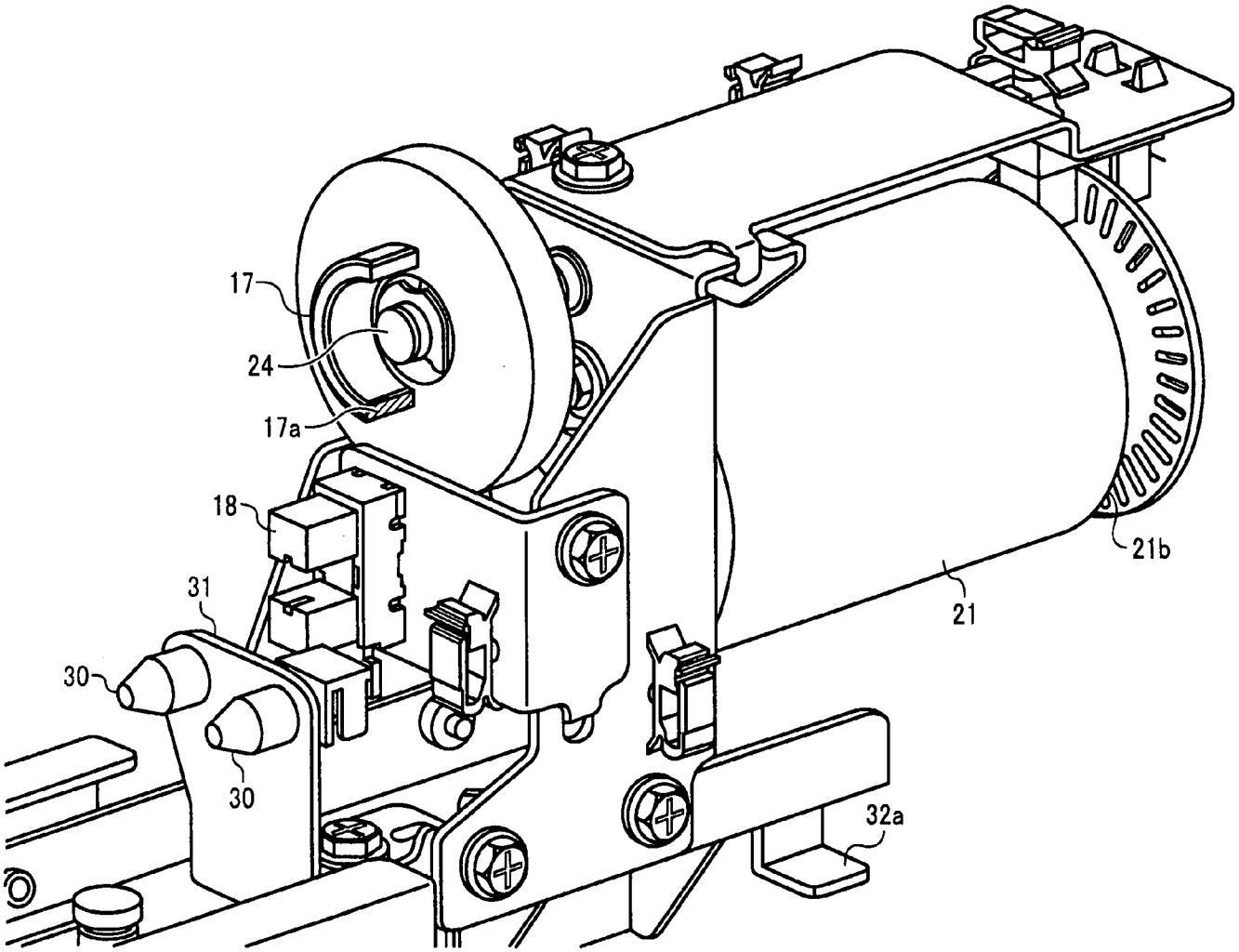
FIG. 10 is an enlarged perspective view of a motor-located section of the punching unit.
Figure 11:
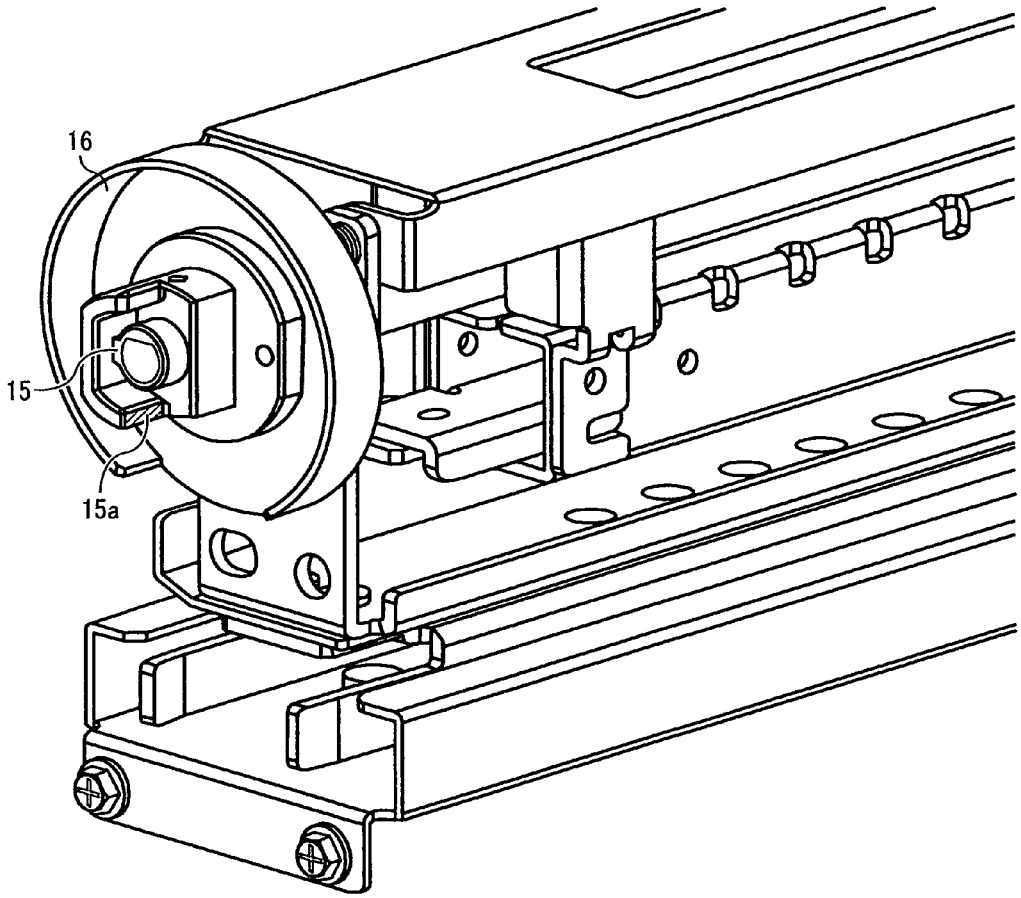
FIG. 11 is an enlarged perspective view of the punching unit on a ratchet-mounted side.
Figure 12:
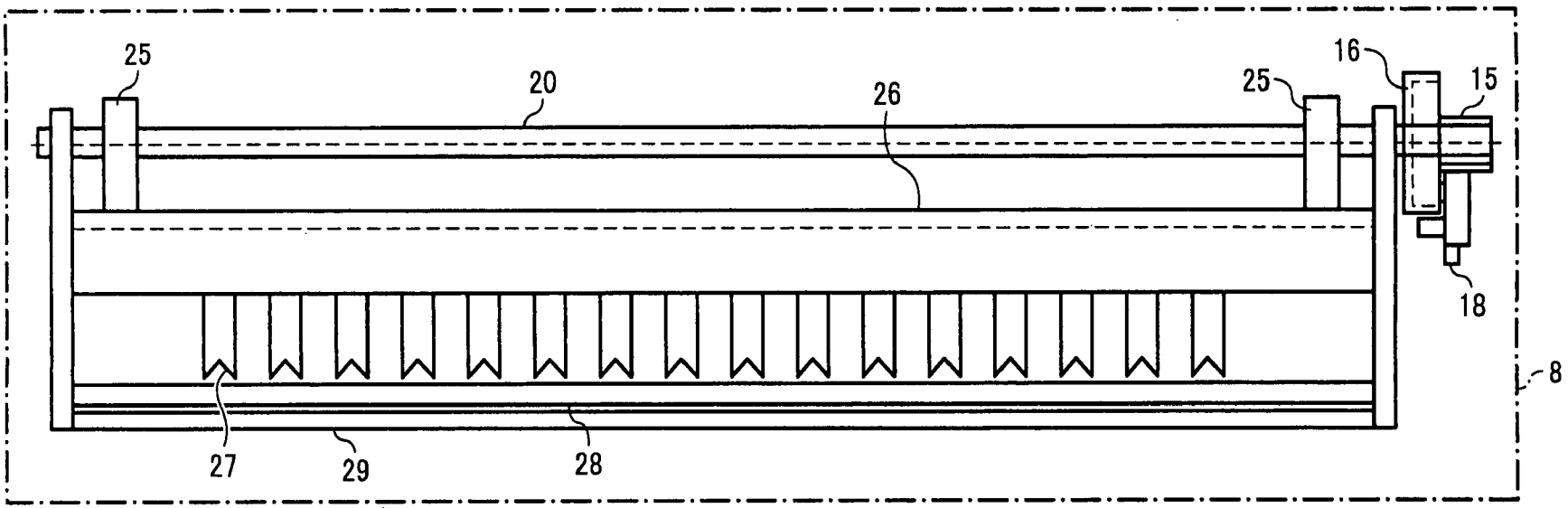
FIG. 12 is a schematic diagram of the punching unit with punch blades.

A punching driving mechanism of the punching unit 8 is explained below with reference to FIGS. 8, 9, 10, 11, and 12. FIG. 8 is a rear view of the punching unit 8. FIGS. 9A, 9B, and 9C are schematic diagrams for explaining punching motion of the punching unit 8. FIG. 10 is an enlarged perspective view of a motor-located section. FIG. 11 is an enlarged perspective view of the punching unit 8. FIG. 12 is a schematic diagram of the punching unit 8 with punch blades 27.

As shown in FIGS. 8 and 9, a shaft 20 passes through the punching unit 8. Cams 25 are fixed to both ends of the shaft 20. The rotation of the cams 25 presses a bracket 26 downwardly (FIG. 9A), and accordingly, the punch blades 27 punch the sheet (FIG. 9B). After the punching, the bracket 26 rises up (FIG. 9C). A detection circular disk 16 and a ratchet 15 are fixed to the end of the shaft 20. As shown in FIGS. 10 and 11, an engaging unit 15*a* of the ratchet 15 contacts with an engaging unit 17*a* of a ratchet gear 17, whereby the rotation is transmitted from the ratchet gear 17 to the ratchet 15. As a result, the shaft 20 and the cams 25 rotate. A driving force is transmitted from a motor 21 to the ratchet gear 17 via a motor gear 21*a*. An encoder 21*b* is fixed to a rear section of the motor 21 on the same axis of a motor shaft. An encoder sensor 22 reads in the pulse, whereby a brake timing or the like is managed. The home position of the punch blades 27 is detected through the detection of a cutout, which is provided to the detection circular disk 16, by means of a home sensor 18. Every time the detection circular disk 16 performs one rotation, the punch blades 27 repeat stops and starts to perform the punching. The punching unit 8 has many punch blades 27 line in a row, thereby indicating the punching unit 8 is intended for, what is called, a multiple-hole punch apparatus that is configured so that only one motion can punch a large number of holes.

Figure 13:
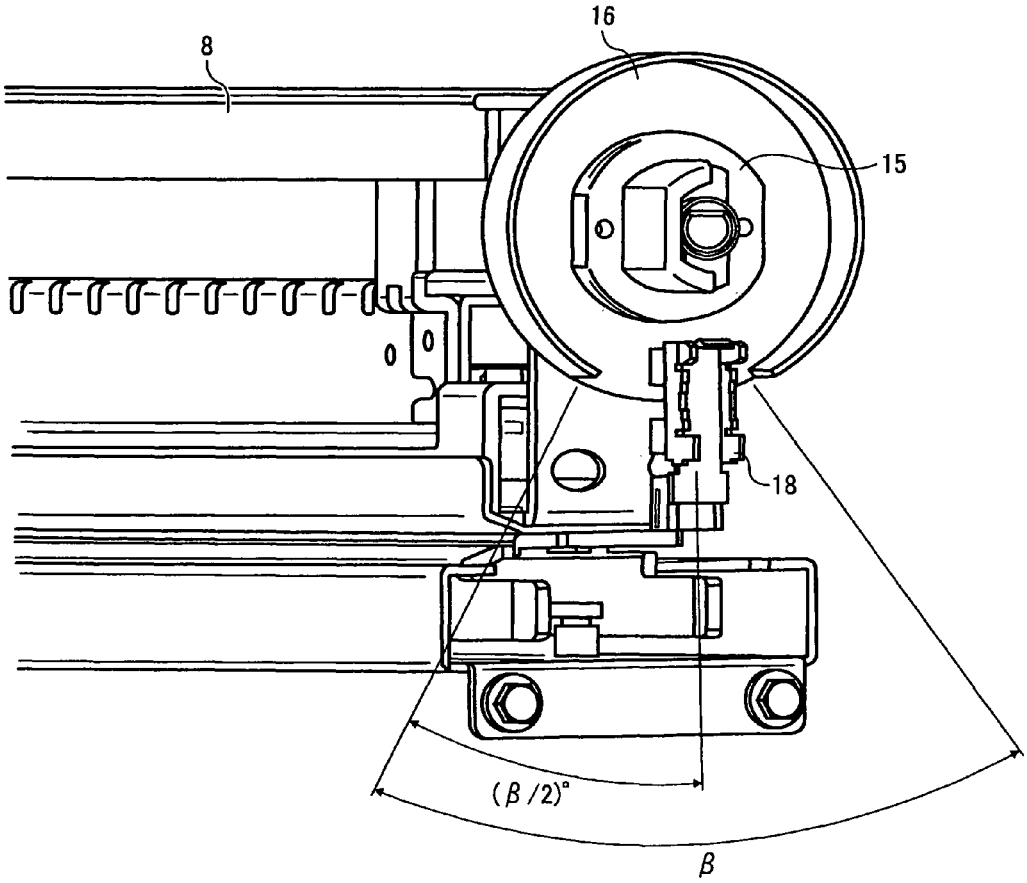
FIG. 13 is a perspective view of a home-position setting mechanism for the punch blades.

The position indicated in FIG. 13 corresponds to the home position of the punch blades 27. However, a position to be targeted corresponds to a position where the home sensor 18 becomes a center of the cutout of the detection circular disk 16 (when an angle of the cutout is β degree, a position of (β/2) degree). Because a punching time and a punching speed change depending on a thickness of the sheet, a temperature environment, a voltage or the like, all the home positions at the time of the punching do not become the position. However, when the home sensor 18 exists within the cutout (within a range of β degree) of the detection circular disk 16 and keeps stopping, the punch blades 27 do not protrude from a punch upper guide plate 28 to a punch lower guide plate 29. If the home sensor 18 passes the cutout of the detection circular disk 16 to stop, the punch blades 27 become in a state to protrude from the punch upper guide plate 28. This state leads to a possibility where the leading end of the next sheet may contact with the punch blades 27, thereby resulting in a wound or a jam. FIG. 13 is a perspective view of a home-position setting mechanism of the punch blades 27.

The motor 21 is fixed to a motor bracket 23. The motor bracket 23 is fixed to the base 32. Therefore, the motor 21 and the motor bracket 23, or all components that are fixed thereto slide together with the base 32 in a moving direction shown in FIG. 2.

After the punching, punch scraps 45 pass through a punch scrap guide 44 shown in FIG. 7 to be accommodated in a hopper 46 as shown in FIG. 1. Because the punching unit 8 is placed at the lowest horizontal portion of a U-shaped conveying path, all the punch scraps 45 have to do is to fall directly below. At that time, the punch scrap guide 44 is required only to secure a path to the base 32.

Figure 15:
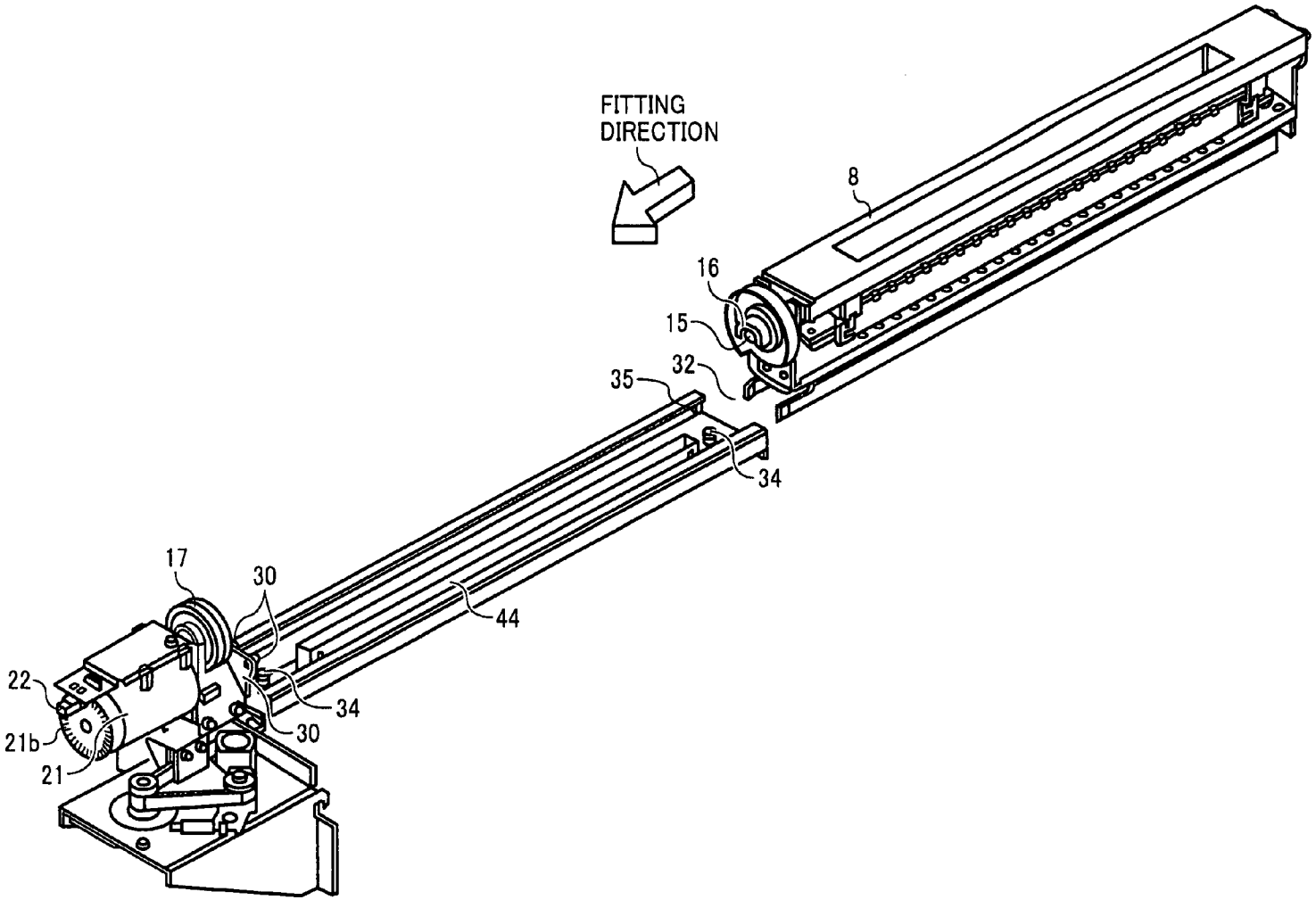
FIG. 15 is a perspective view of the punching unit replaced with a new one viewed from one side.
Figure 16:
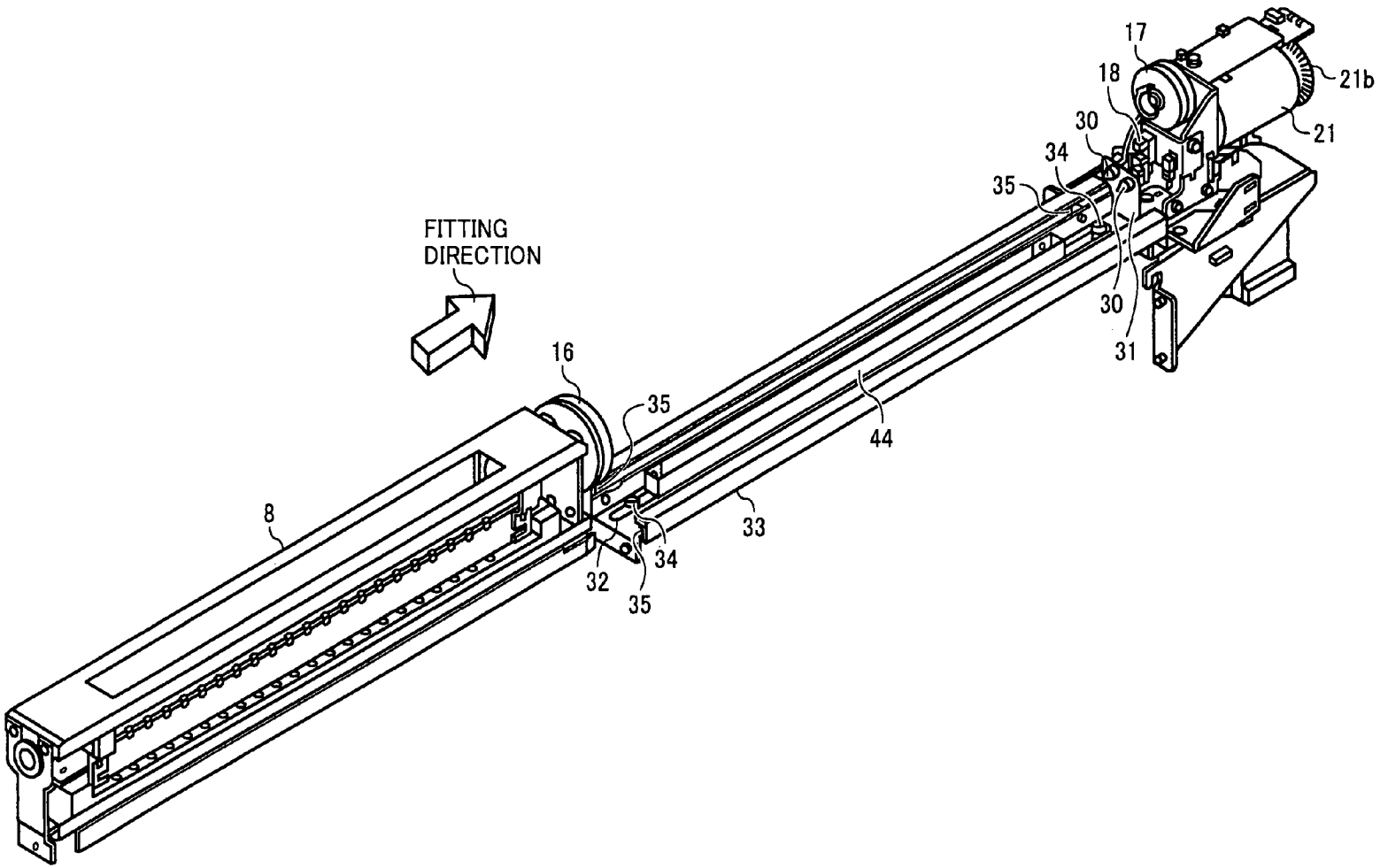
FIG. 16 is a perspective view of the punching unit replaced with a new one, which is viewed from the opposite side.

As shown in FIGS. 15 and 16, the punching unit 8 can be replaced only by removing the finger screw 36 from a front surface of the apparatus. The punching unit 8 moves in a sliding manner toward the near side in a state where the ratchet 15 and the detection circular disk 16 have been fixed to the punching unit 8. In a state where the punching unit 8 has been removed, the engaging units 15*a* and 17*a* become in a state to be spaced from each other. Therefore, a transmission of the drive is blocked. Just because the punching unit 8 is in a state to be blocked, a driving unit is not attached to the removed punching unit 8, resulting in a save of efforts at the time of a replacement. If the driving unit is attached to the punching unit 8, a removing work of a connector occurs and efforts thereof are required, and cost for the replacement becomes high also as a replacement unit. This configuration allows replacement of the punching unit 8 easily and in a cheap unit based on usability of a user.

When the punching unit 8 is attached to the apparatus, as described above, the engaging units 15*a* and 17*a* of the ratchet 15 and of the ratchet gear 17, respectively, may not engage with each other. At that time, the ratchet 15 presses the ratchet gear 17 to slide the shaft 24, whereby the punching unit 8 is attached while at the same time a spring 19 is compressed. At this time, when an initial motion is activated, the ratchet gear 17 rotates. Accordingly, when the ratchet gear 17 becomes an engaging position with the ratchet 15, the spring 19 presses the ratchet gear 17, whereby the engaging units becomes in a state to be capable of transmitting the drive.

Figure 14:
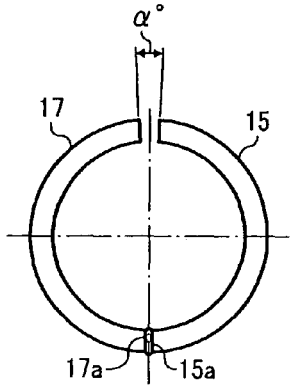
FIG. 14 is a schematic diagram for explaining that a ratchet and a ratchet gear are capable of engaging with each other at an initial time.

FIG. 14 a schematic diagram for explaining the state. A surface spaced by a clearance having α degree is provided at a position opposite to the engaging units 15*a* and 17*a*. The clearance enables the ratchet 15 and the ratchet gear 17 to engage with each other at the time of an initializing.

Figure 17:
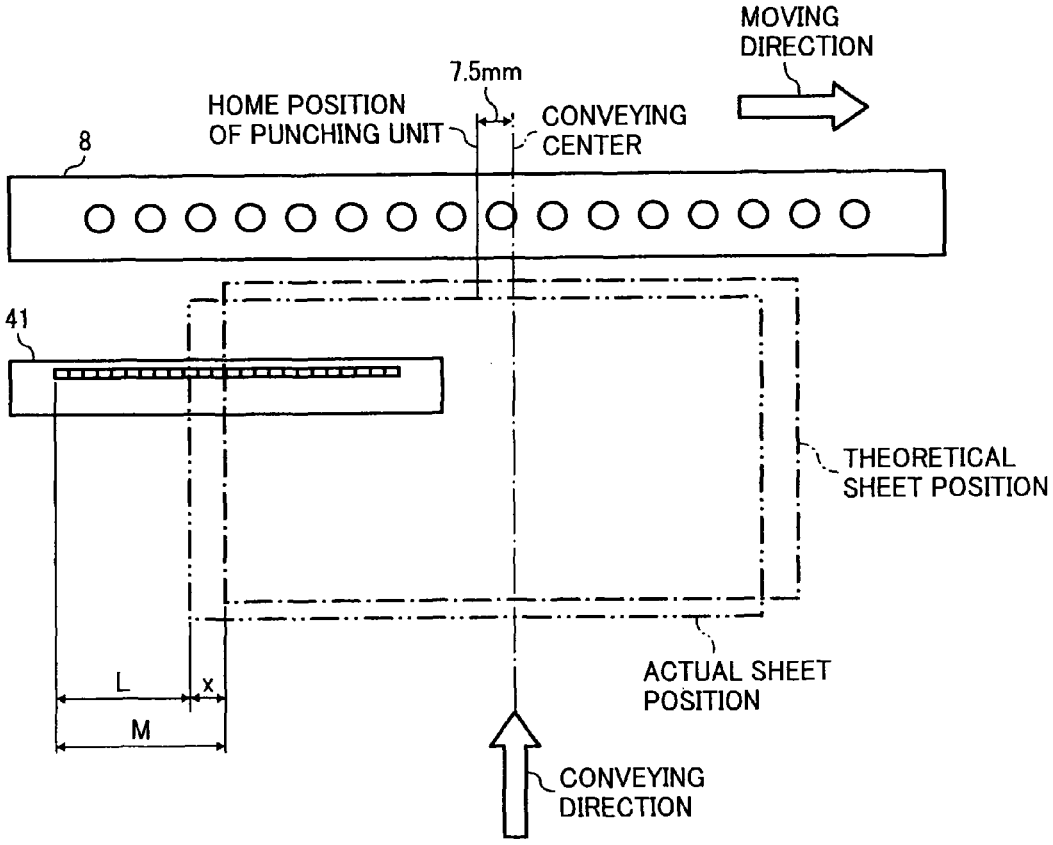
FIG. 17 is a schematic diagram for explaining a positional relationship between the lateral registration sensor, the punching unit, and a sheet to be conveyed.

FIG. 17 is a schematic diagram for explaining the positional relationship between the CCD line sensor 41 (the lateral registration sensor S2), the punching unit 8, and the sheet to be conveyed. In FIG. 17, the punching unit 8 is capable of moving in a direction (an arrow indicated by "moving direction") perpendicular to the sheet conveying direction by means of the stepping motor 39. The punching unit 8 is controlled so as to align a stop position thereof relative to an actual position of the sheet that has been conveyed, thereby creating the punch position having high accuracy.

The CCD line sensor 41 detects an end surface of the sheet, and then, detects a distance indicated by "L", and accordingly, a difference X between the "L" and a theoretical (ideal) distance "MM" is calculated, whereby a misalignment amount is calculated. Supposing that the distance between the home position and ideal position of the punching unit 8 is 7.5 millimeters, when the punching unit 8 moves by 7.5 millimeters-X millimeters, the punching unit 8 is capable of performing the punching at an adequate position.

Figure 18:
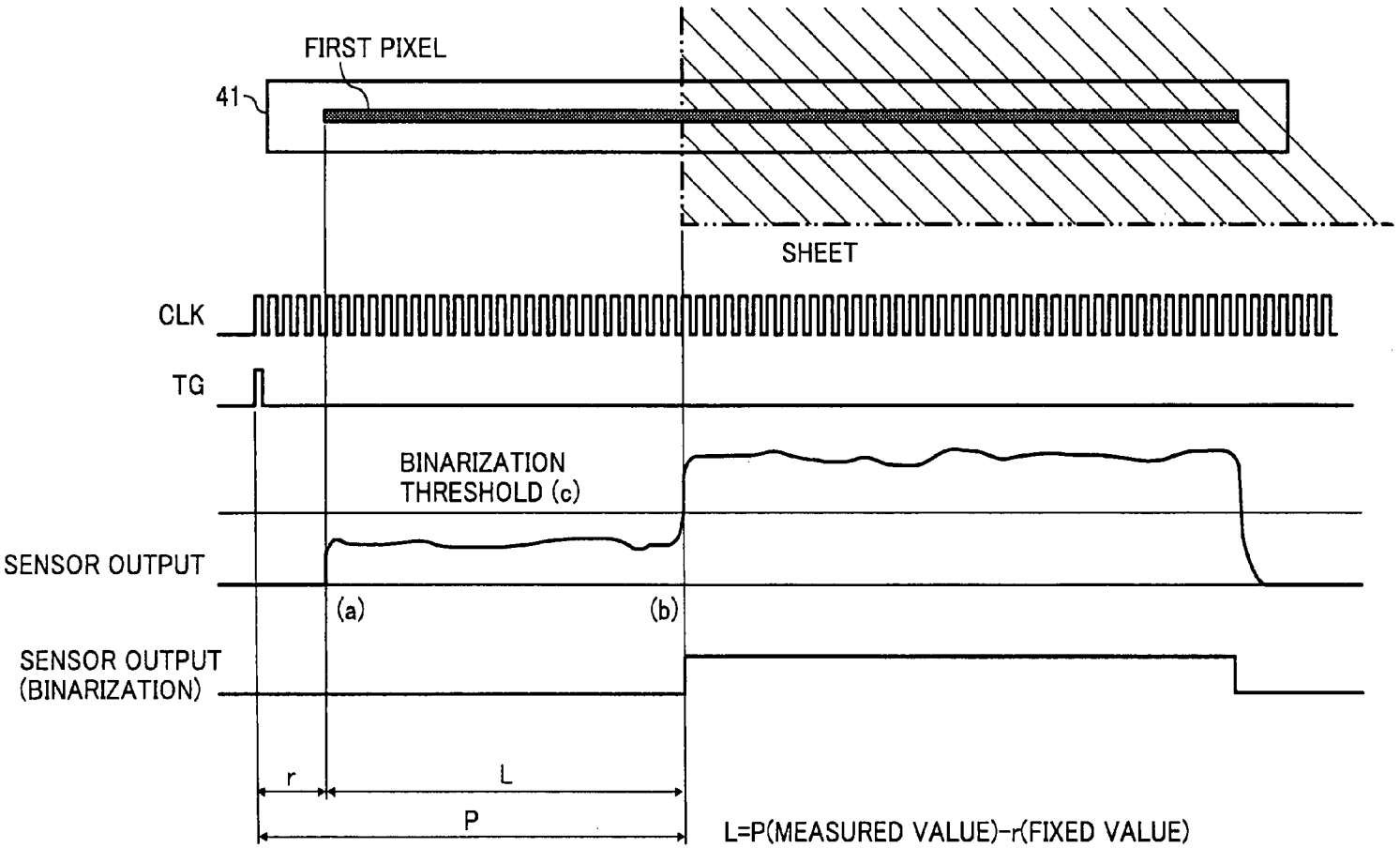
FIG. 18 is a timing chart of detection of a sheet by the lateral registration sensor.

The following is a description with reference to FIG. 18 of detection of a sheet by the CCD line sensor 41 (the lateral registration sensor S2). A clock (CLK) is input in the CCD line sensor 41 and also a trigger signal (TG) for a measurement start is given to the CCD line sensor 41, whereby a measurement is started. After the predetermined number of the clocks ("r" in FIG. 18), an output from the CCD line sensor 41 is performed per one pixel by one clock from the first pixel. Higher a reflection ratio of the sheet becomes, higher an output level of this sensor output becomes. Therefore, when an analog output from the sensor is binarized by use of an adequate thresh level (a binarization thresh (c) in FIG. 18), the output can be digitalized depending on whether the sheet exists. In an example shown in FIG. 18, because the sensor output is low at points from (a) to (b), the binarized output becomes low level, and after (b) where the sheet has existed, because the sensor output is higher than the thresh level, the binarized output becomes high level. Regarding a sheet-position detection, the number of the clocks from the trigger signal (TG) to the binarization output becomes high level are counted, or a time from the trigger signal (TG) until the binarization output becomes high level is measured, whereby "P" in FIG. 18 is measured. The position of the sheet is obtained from the first pixel of the CCD line sensor 41 using the following Equation:

$$L=P-r$$

where L corresponds to "L" indicated in FIG. 17. Accordingly, the misalignment amount is obtained by use of "M-L".

As described above, the higher the reflection ratio of the sheet is, the higher the output from the CCD line sensor 41 (the lateral registration sensor S2) becomes. However, when a color of the sheet is dark, or a dark image has been printed to the end surface of the sheet, the difference between the output level at the time when the sheet exists and the output level at the time when the sheet does not exist becomes smaller. Accordingly, the detection failure may occur. When such sheet is included in a job, the apparatus has been generally stopped as an abnormality. However, in most cases, the position of the sheet has not been misaligned to a great extent, compared with the sheet before and after. Accordingly, when the sheet is punched at an assumed position, the punching has not lead to any problems. The present invention focuses on how the sheet position is assumed in such case.

Figure 19:
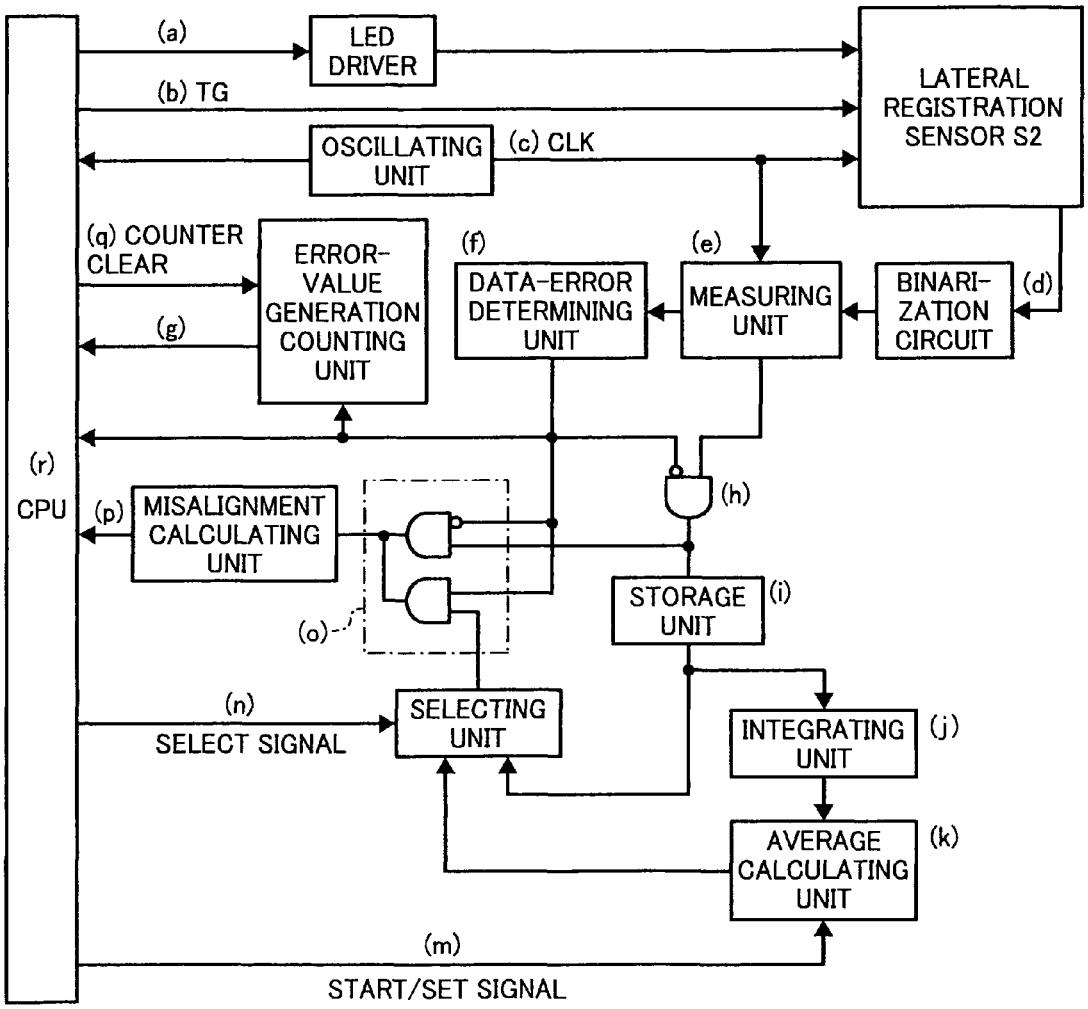
FIG. 19 is a functional block diagram of a control circuit for detecting a lateral registration misalignment of a sheet.

FIG. 19 is a functional block diagram of a control circuit for detecting a lateral registration misalignment of a sheet. A central processing unit (CPU) (r) having 1 chip performs a control relative to the apparatus. The CPU (r) performs the control of a light emitting diode (LED) driver ("(a)" in FIG. 19), the control of a trigger signal (b) for the measurement start, and the control of an oscillating unit to oscillate the clock, relative to the lateral registration sensor S2. An analog output (d) from the lateral registration sensor S2 is digitalized by a binarization circuit to be input to a measuring unit (e). The measuring unit (e) measures the number of the clocks (CLK) until a high level edge corresponding to a sheet end, thereby measuring the sheet position. The measured result is input to a data-error determining unit. When the obtained data deviates from the general position of the sheet size, or the sheet end cannot be detected, the data-error determining unit determines as the abnormality to input an abnormal signal (at the abnormal time=1) to each gate circuit, the CPU (r), and an error-value generation counting unit. The error-value generation counting unit can count the number of times of the error signals output from the data-error determining unit (f). The output from a counter is output to the CPU (r) ("(g)" in FIG. 19). A counter-clear signal (q) from the CPU (r) clears a counter content. A storage unit (i) stores therein the output from the measuring unit (e) by way of the gate circuit (h), when the data is not erroneous (when the output from the data-error determining unit is "0").

At the time of storing, it is also possible to store the output per the sheet size, or to classify the output depending on a job content to store the output. Regarding the data in the storage unit (i), after an integrating unit (j) has integrated the necessary data in the storage unit (i) in response to an instruction from the CPU (r), an average calculating unit (k) calculates an average. A misalignment calculating unit (p) is provided to calculate the misalignment amount of the sheet end. When the data is not erroneous, the result from the measuring unit (e) is input to the misalignment calculating unit (p) by way of the gate circuit (o). When the data is erroneous, the data, which a selecting unit (n) has selected, is input to the misalignment calculating unit (p). The misalignment calculating unit (p) calculates the misalignment amount of the sheet end, and then, the result from the calculation is input to the CPU (r). The CPU (r) drives the stepping motor 39, which is not shown, by the amount depending on the misalignment amount to move the punching unit 8 to the adequate position.

Examples of control processes performed at the error time are explained below.

Figure 20:
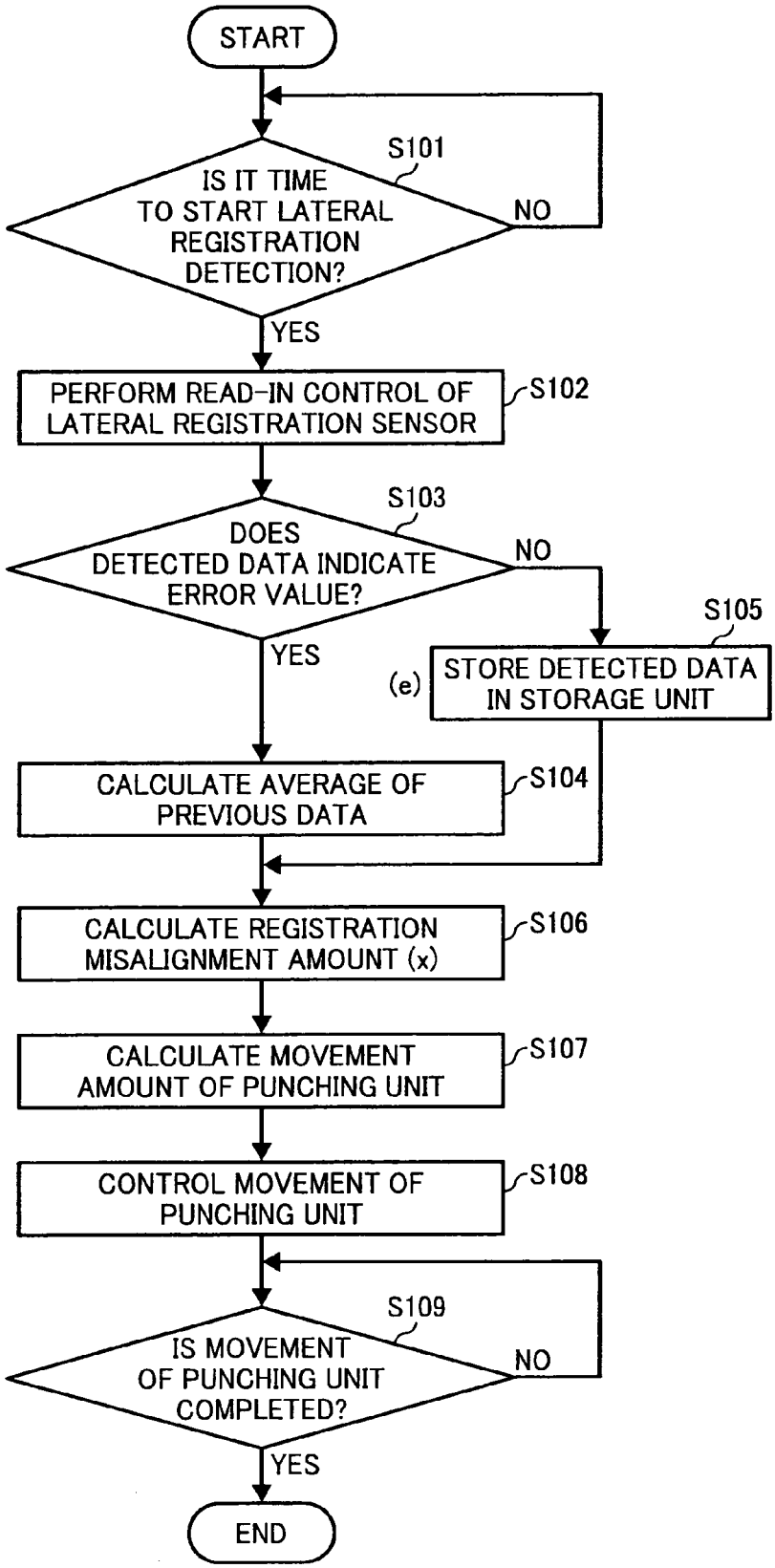
FIGS. 20 to 27 are flowchart of examples of control process performed when the lateral registration sensor detects error data.

FIG. 20 is a flowchart of an example of a control process performed by the CPU (r) when the lateral registration sensor S2 has detected error data.

The CPU (r) waits until time to start the lateral registration detection (step S101), and when the time comes, performs a read-in control (step S102). The read-in control is described above. When the read-in control of the lateral registration sensor S2 is finished, the CPU (r) determines whether detected data indicates an error value (step S103). When the detected data does not indicate an error value, the CPU (r) stores the detected data in the storage unit (step S105). When the detected data indicates an error value, the CPU (r) calculates the average of previous data (step S104), and then, calculates registration misalignment amount (x) (step S106). In the calculation of registration misalignment amount, when the detected data is not erroneous, the CPU (r) uses the detected data to calculate the registration misalignment amount (x).

After calculating the registration misalignment amount (x) at step S106, the CPU (r) calculates a movement amount of the punching unit 8 (step S107) to subsequently control movement the punching unit 8 (step S108). Thereafter, the CPU (r) waits completion of movement of the punching unit 8 (step S109).

As described above, even in a state where the end of the sheet cannot be detected for some reasons, fluctuation characteristics of the apparatus can be acquired from the average of previous data. This makes it possible to perform the punching at a level where any problems do not exist from a practical standpoint and to improve the productivity without stopping the apparatus.

Figure 21:
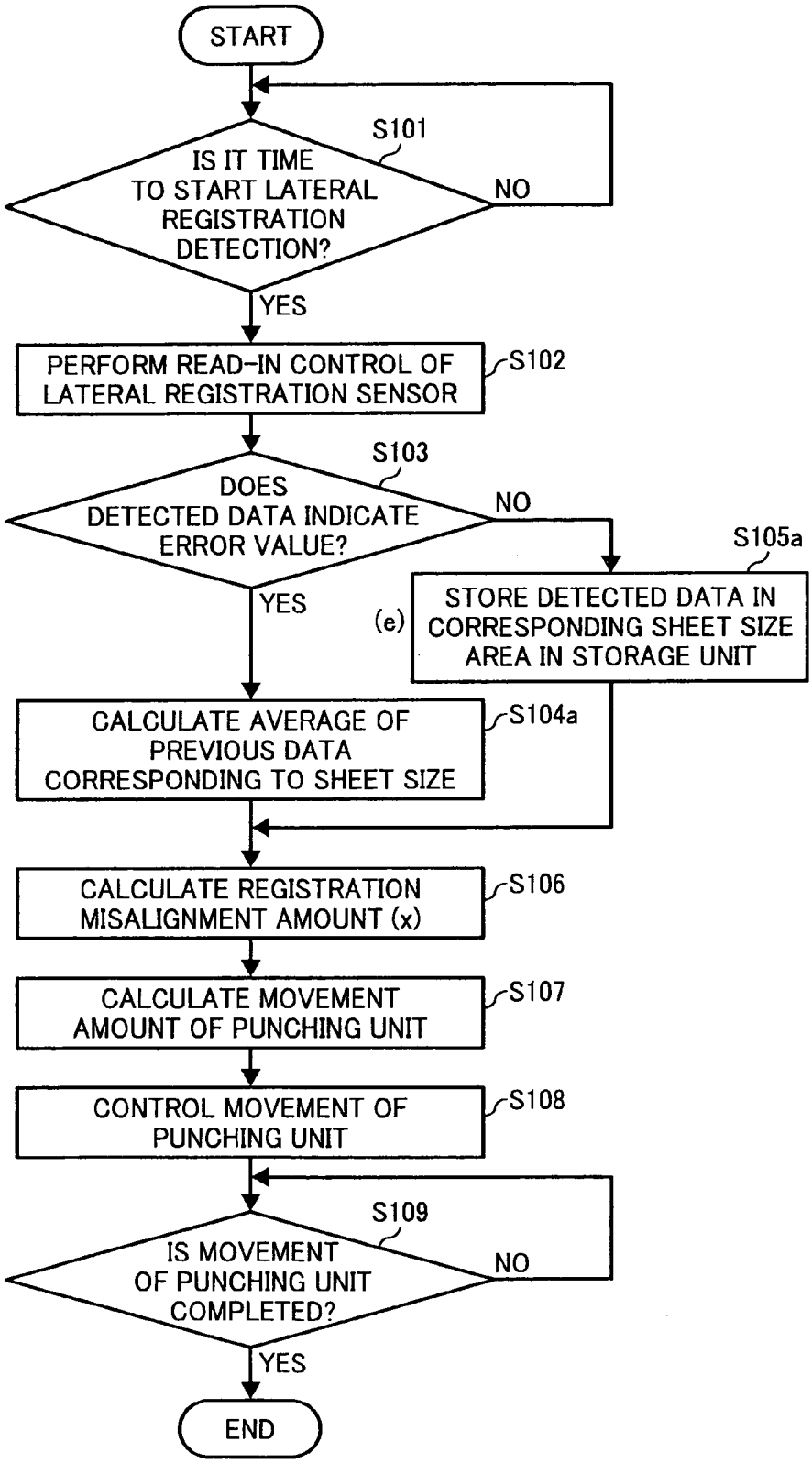

FIG. 21 is a flowchart of another example of a control process performed when the lateral registration sensor S2 has detected error data, in which a sheet conveying reference is a central reference. Described below is a difference from the control process shown in FIG. 20. At steps S104 and S105, both of which are performed after determination as to the error value at step S103, in this example, the CPU (r) assigns and stores sheet-edge data in a storage area with respect to each sheet size when storing the detected data in the storage unit (i) (step S105*a*), and when using the data until the previous time, the CPU (r) uses only the sheet-edge data corresponding to the same size as the current sheet size to calculate the average (step S104*a*). The process from step S101 to step S109 except the steps S104*a* and S105*a* are the same as previously described in connection with FIG. 20.

With this, it possible to improve the productivity without stopping the apparatus even in the state where the edge of the sheet cannot be detected for some reasons. This is because the fluctuation characteristics per the sheet size in the finishing device PD in use appears on the average of the data until the previous time, it is possible to perform the punching at the level where any problems do not exist from a practical standpoint by using the average of the size data until the previous time.

Figure 22:
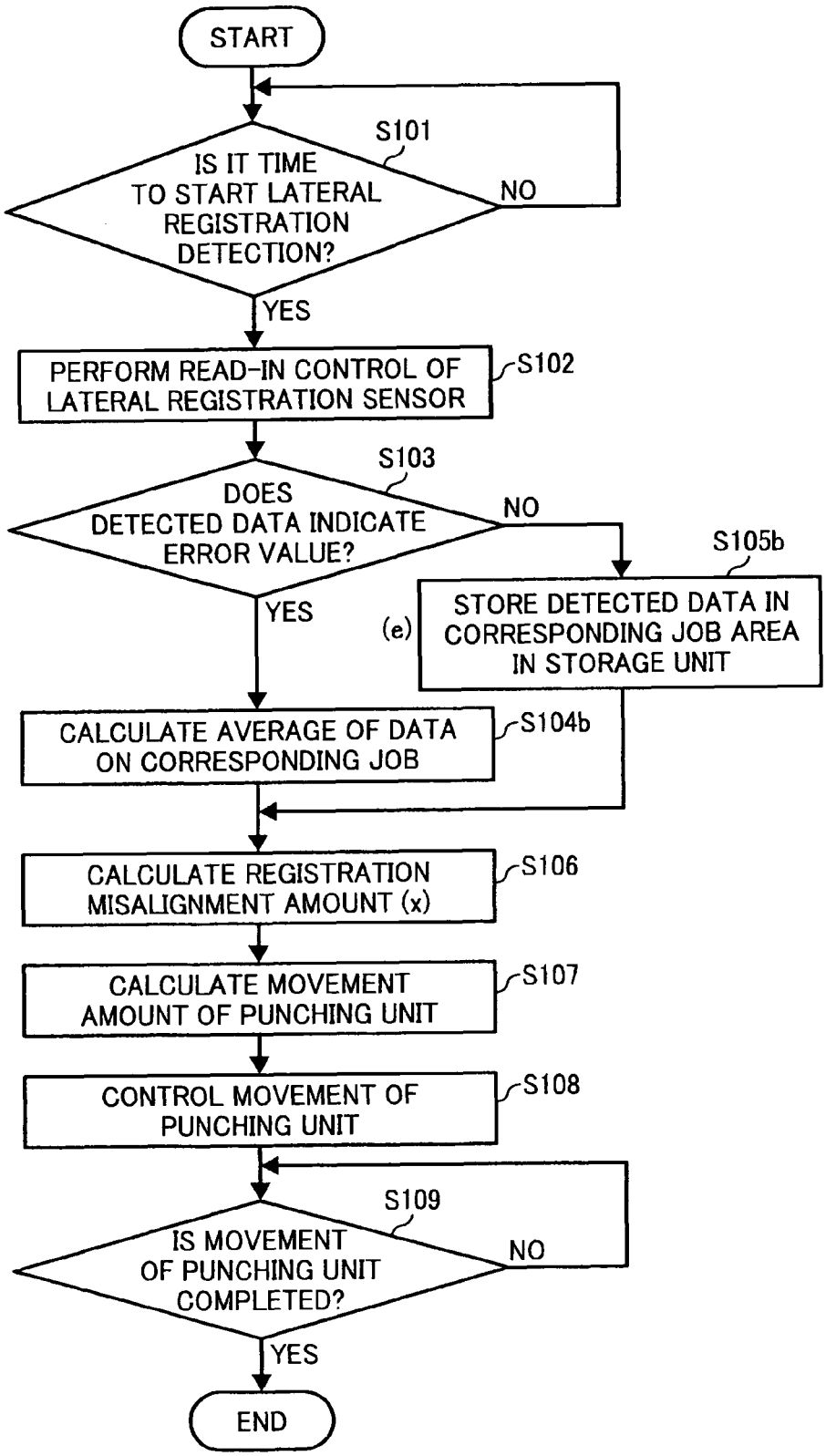

FIG. 22 is a flowchart of still another example of a control process performed when the lateral registration sensor S2 has detected error data, in which the CPU (r) performs the control process by use of sheet-edge data on other sheets in the same job where an error has been detected. Described below is a difference from the control process shown in FIG. 20. At steps S104 and S105, both of which are performed after determination as to the error value at step S103, in this example, when any error does not exist, the CPU (r) stores the detected data in a storage area, which is used when performing the same job, in the storage unit (i) (step S105*b*), and when the detected data is error data, the CPU (r) calculates the average of data stored in the storage area for the job (step S104*b*). The process from step S101 to step S109 except the steps S104*a* and S105*a* are the same as previously described in connection with FIG. 20.

With this, it is possible to, because sheets of the same kind (in manufacturer or sheet quality) are mostly fed from the same sheet feeding tray when in the same job, use the data whose misalignment characteristics is more similar by using the data on the job, thereby improving the accuracy of the punching position. In addition, only the data on the current job are stored. This system makes it possible to reduce costs, because it is possible to use not a nonvolatile memory, but a cheap memory.

Figure 23:
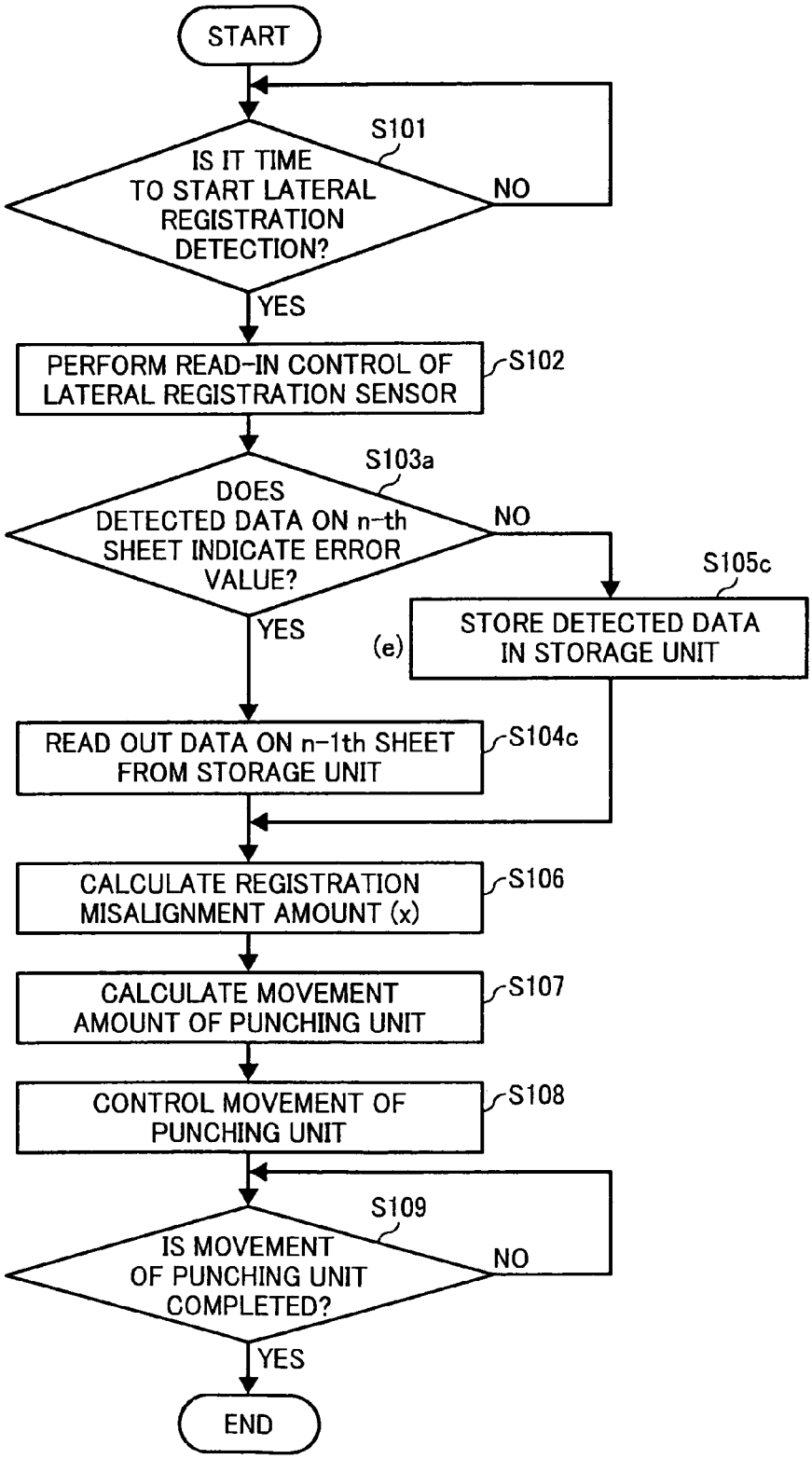

FIG. 23 is a flowchart of still another example of a control process performed when the lateral registration sensor S2 has detected error data. This control process is further simplified compared with that shown in FIG. 22 by use of sheet-edge data on the previous sheet of a sheet where the error value has been detected. Described below is a difference from the control process shown in FIG. 22. When the detected data at step S103 is not erroneous (NO at step S103*a*), the CPU (r) stores the detected data in the storage unit (i) (step S105*c*). When the detected data is erroneous (YES at step S103*a*), the CPU (r) reads out from the storage unit (i) the sheet-edge data on the previous ("n−1") sheet compared with the sheet where the error has been detected (step S104*c*), and at step S106, the CPU (r) calculates the registration misalignment amount based on the data read out at step S104*c*.

Such processing leads to minimization of a memory amount, and makes it possible to perform the processing at the error time after simplifying the processing.

Figure 24:
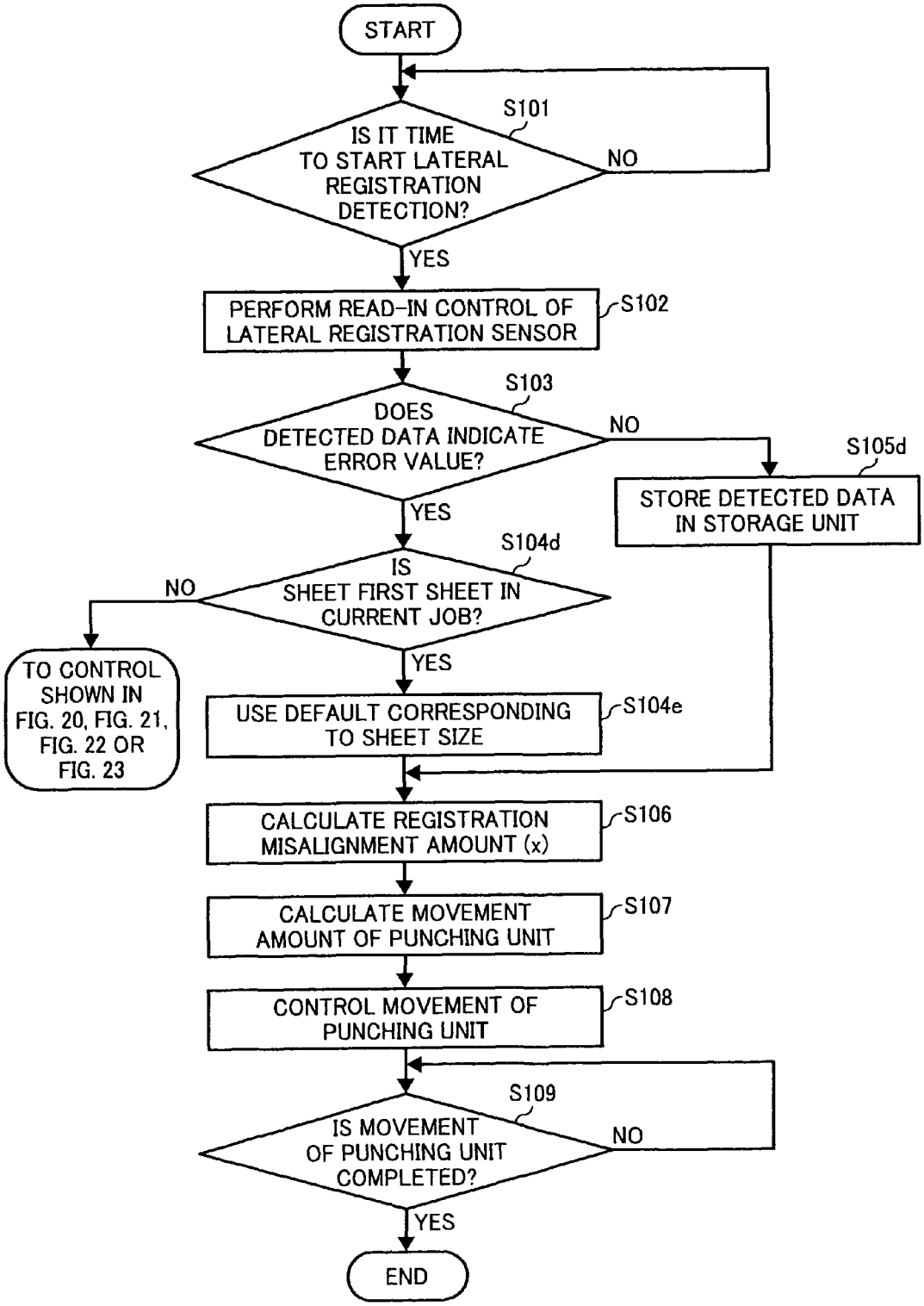

FIG. 24 is a flowchart of still another example of a control process performed when the lateral registration sensor S2 has detected error data. The control process shown in FIGS. 20 to 23 is based on the assumption that data on a plurality of sheets exists, and therefore, when an error value is detected, the error can be handled by use of data before the detection at the error time in the same job. However, when the sheet, where the error has been detected, is the first sheet in a job, any comparison targets do not exist. Accordingly, the CPU (r) cannot perform the control process shown in FIGS. 20 to 23. In this example, when an error value is detected at the first sheet in a job, the CPU (r) uses default with respect to each sheet size to perform the process at the error time.

Described below is a difference from the control process shown in FIG. 20. At steps S104 and S105, both of which are performed after determination as to the error value at step S103, in this example, when any error does not exist, the CPU (r) stores the detected data in the storage unit (i) (step S105*d*). When the detected data indicates an error value, the CPU (r) checks whether the sheet is the first sheet in the current job. If not, the CPU (r) performs any one of the control process shown in FIGS. 20 to 23. On the other hand, when it is the first sheet, the CPU (r) reads out from the storage unit (i) default of the sheet edge corresponding to the sheet size (step S104*e*). The process from step S101 to step S109 except the steps S104*d*, S104*e*, and S105*d* are the same as previously described in connection with FIG. 20.

With this, it is possible to perform the punching at an acceptable punching position without stopping the processing by using the default per the sheet size, even when the error value is detected at the first sheet in the job.

Figure 25:
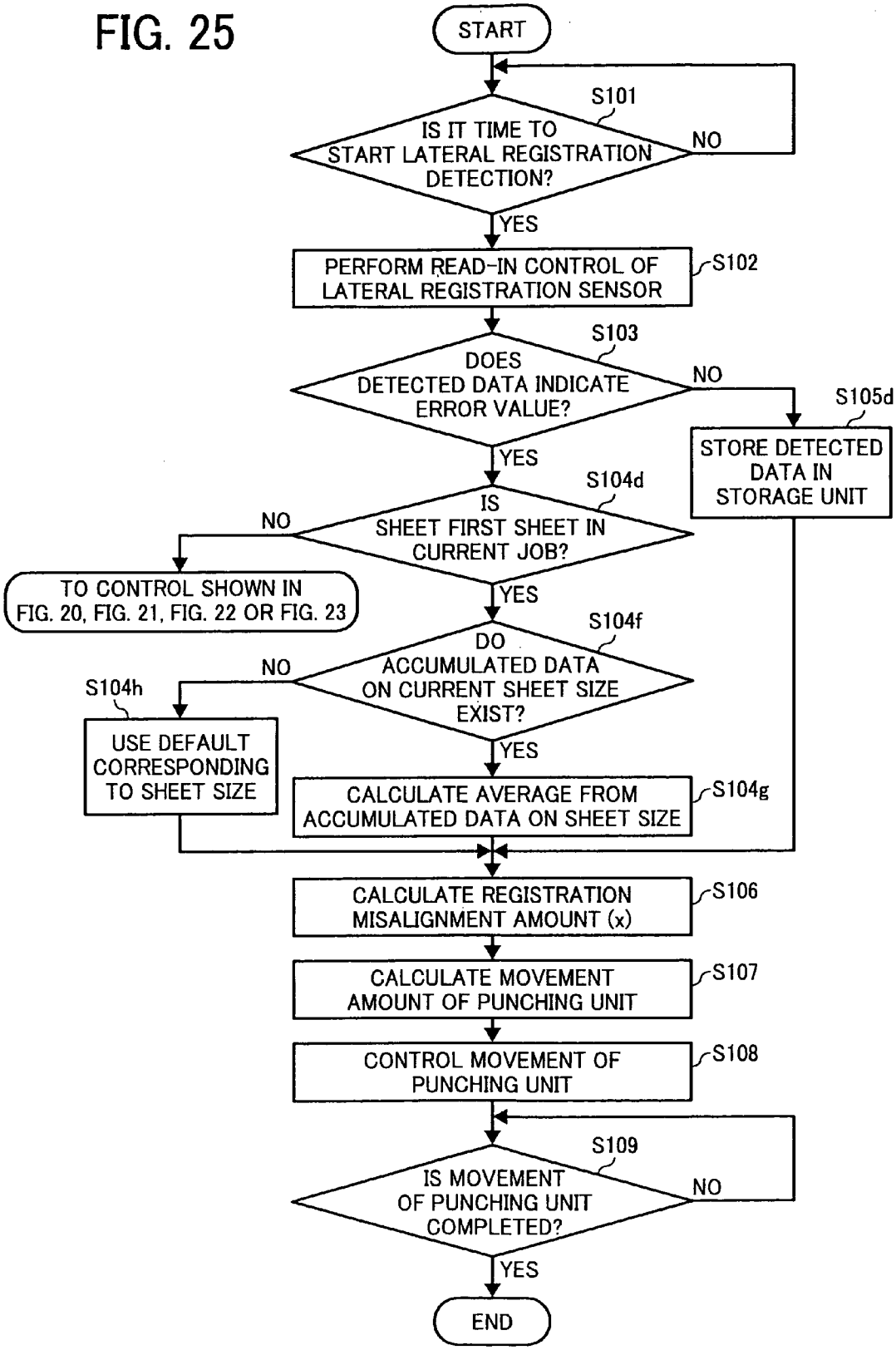

FIG. 25 is a flowchart of still another example of a control process performed when the lateral registration sensor S2 has detected error data.

In the example explained above in connection with FIG. 24, when an error value is detected on the first sheet, default with respect to each sheet size, which has been stored in the storage unit (i) in advance, is used. This makes it possible to obtain acceptable position accuracy in the control process shown in FIG. 24. However, this data is not relative to the actual sheet. Therefore, it is not possible to handle more accurate punching position. Consequently, in this example, in combination of the control process of FIG. 24 and the control process of FIG. 21, when accumulated data on corresponding sheet size of the sheet exists in the storage unit (i) (Yes at step S104*f*), the CPU (r) calculates the average of the sheet edge from the accumulated data on the sheet size (step S104*g*), and when calculating the registration misalignment amount, the CPU (r) uses the average calculated at step S104*g*. When the accumulated data on the sheet size do not exist at step S104*f*, the CPU (r) uses default corresponding to the sheet size (step S104*h*) in the same manner as previously described in connection with FIG. 24 in calculating the registration misalignment amount in step S106. The process except the steps S104*f*, S104*g*, and S104*h* are the same as previously described in connection with FIG. 20.

With this, it is possible to, when the accumulated data on the sheet size in the current job exist, improve the accuracy of the punching position compared with the case of FIG. 24, because the CPU (r) uses the average of the accumulated data, although, in the control process of FIG. 24, the default is used in all the cases when the error occurred at the first sheet.

Figure 26:
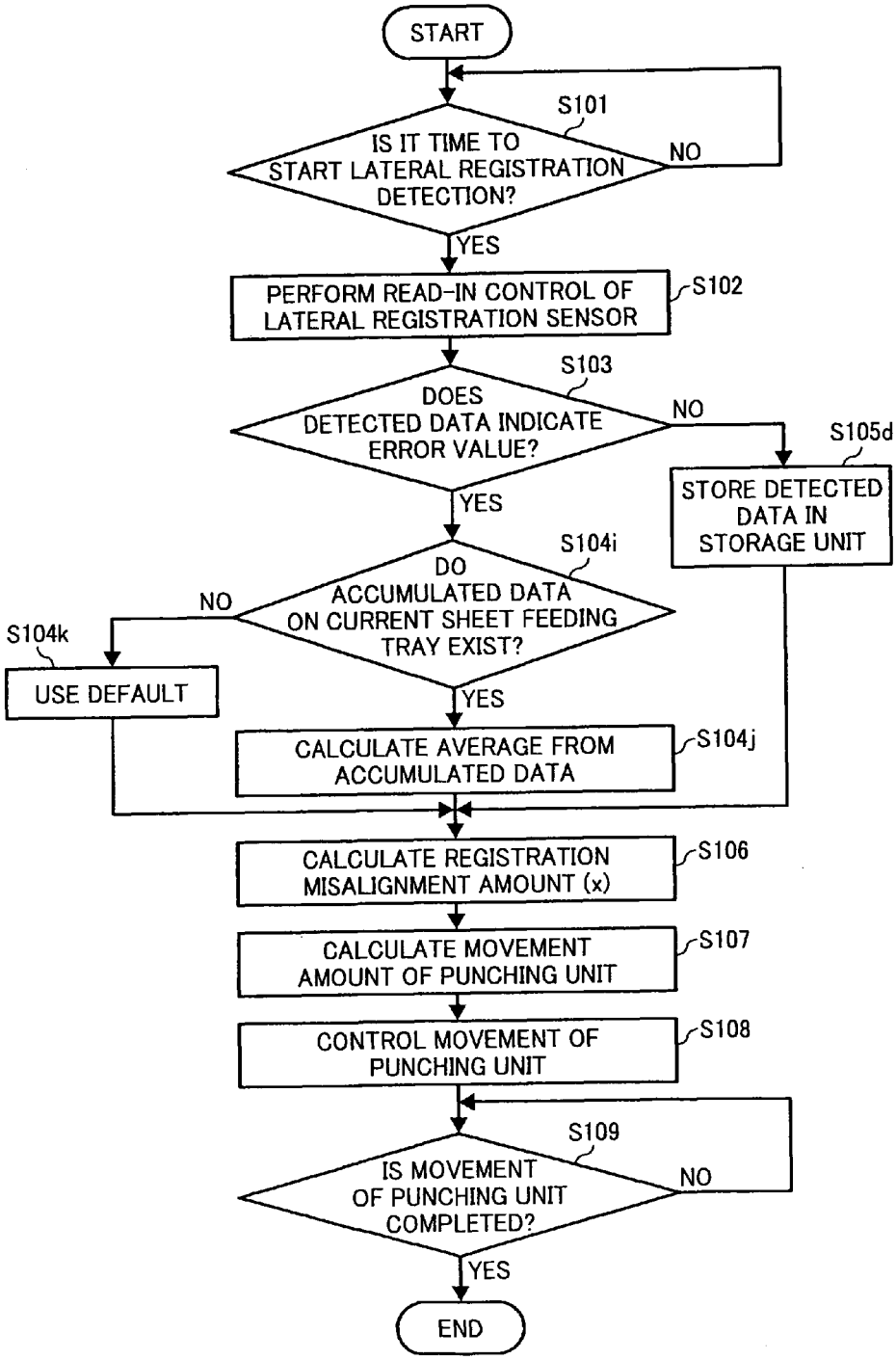

FIG. 26 is a flowchart of still another example of a control process performed when the lateral registration sensor S2 has detected error data based on accumulated data relative to the sheet feeding tray in use to handle the case when the error value is detected. Described below is a difference from the control process shown in FIG. 20. At steps S104 and S105, both of which are performed after determination as to the error value at step S103, in this example, the CPU (r) changes a processing method depending on whether accumulated data on the sheet in the sheet feeding tray in use exist (step S104*i*). In other words, when the detected data does not indicate an error value, the CPU (r) stores the detected data in the storage unit (i) at step S105*d*. When the detected data is an error value, the CPU (r) performs a check at step S104*i*. When the accumulated data exist, the CPU (r) calculates the average of the sheet position (sheet-edge position) from the accumulated data, i.e., data accumulated when the corresponding sheet feeding tray is used (step S104*j*) to calculate the registration misalignment amount by use of the average. On the other hand, when the accumulated data do not exist at step S104*i*, the CPU (r) uses the default per the sheet size (step S104*k*) in the same manner as previously described in connection with FIG. 24 in calculating the registration misalignment amount in step S106. The process from step S101 to step S109 except the steps S104*i*, S104*j*, S104*k*, and S105*d* are the same as previously described in connection with FIG. 20.

With this, it is possible to perform the position correction including a mounting position error of the sheet feeding tray, because the positional data on the sheet per the sheet feeding tray is used.

Figure 27:
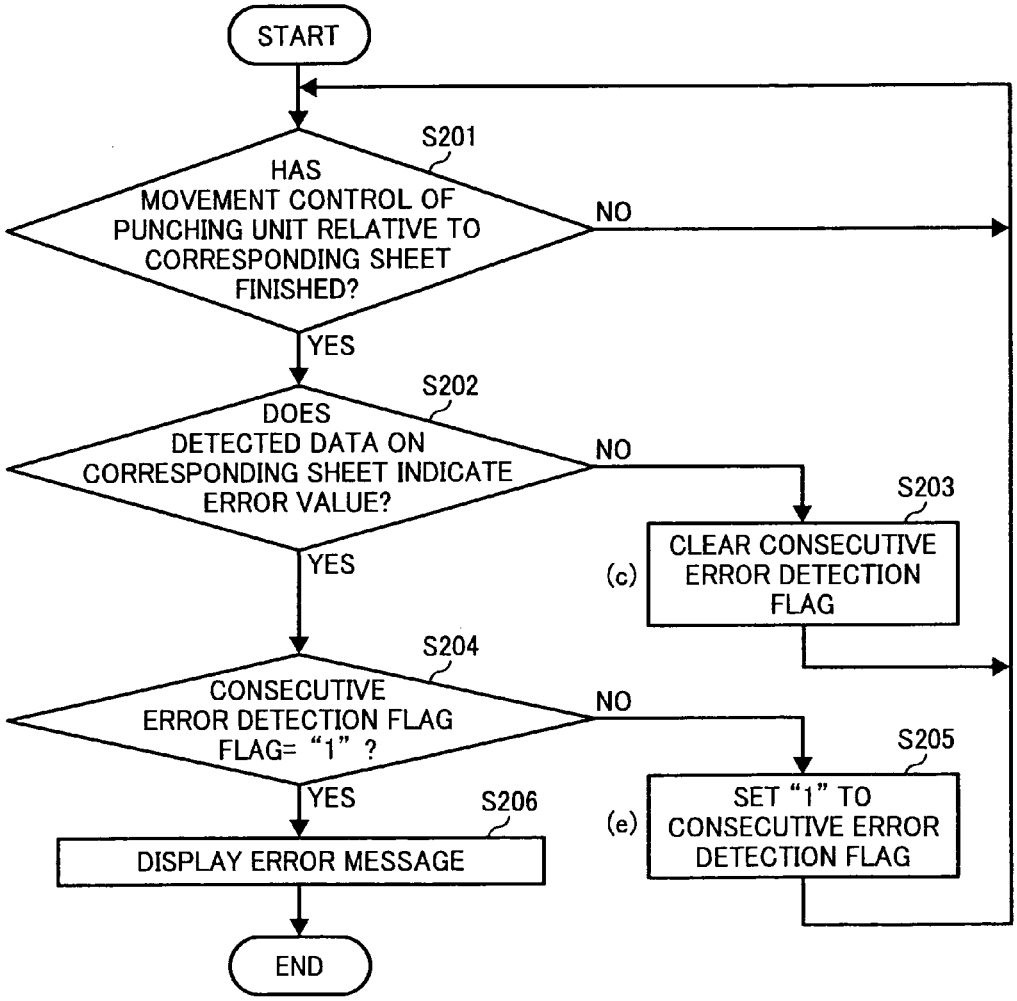

FIG. 27 is a flowchart of an example of a control process performed when the lateral registration sensor S2 has consecutively detected error data.

When error is consecutively detected, it is highly possible that not error due to an effect of an image or to a sheet characteristic, but literal error has occurred. Therefore, in this example, the CPU (r) waits until control of the movement of the punching unit 8 relative to the current sheet is finished (step S201) to determine whether the movement is based on an error value (step S202). When the movement is not based on an error value, the CPU (r) clears a consecutive error detection flag (step S203). Thereafter, the process control returns to step S201 to wait until the next movement control is finished.

When the movement control is based on an error value, CPU (r) checks whether the consecutive error detection flag is "1" (step S204). When the consecutive error detection flag is not "1", the CPU (r) sets "1" to the consecutive error detection flag ((e) step S205). Thereafter, the process control returns to step S201 to wait until the next movement control is finished. When the consecutive error detection flag is "1", which indicates that the sheet indicative of an error value has been consecutive. The CPU (r) determines such case as error, and then, displays that an error may have occurred on a display unit (step S206) to notify the user of the error.

Figure 28A:
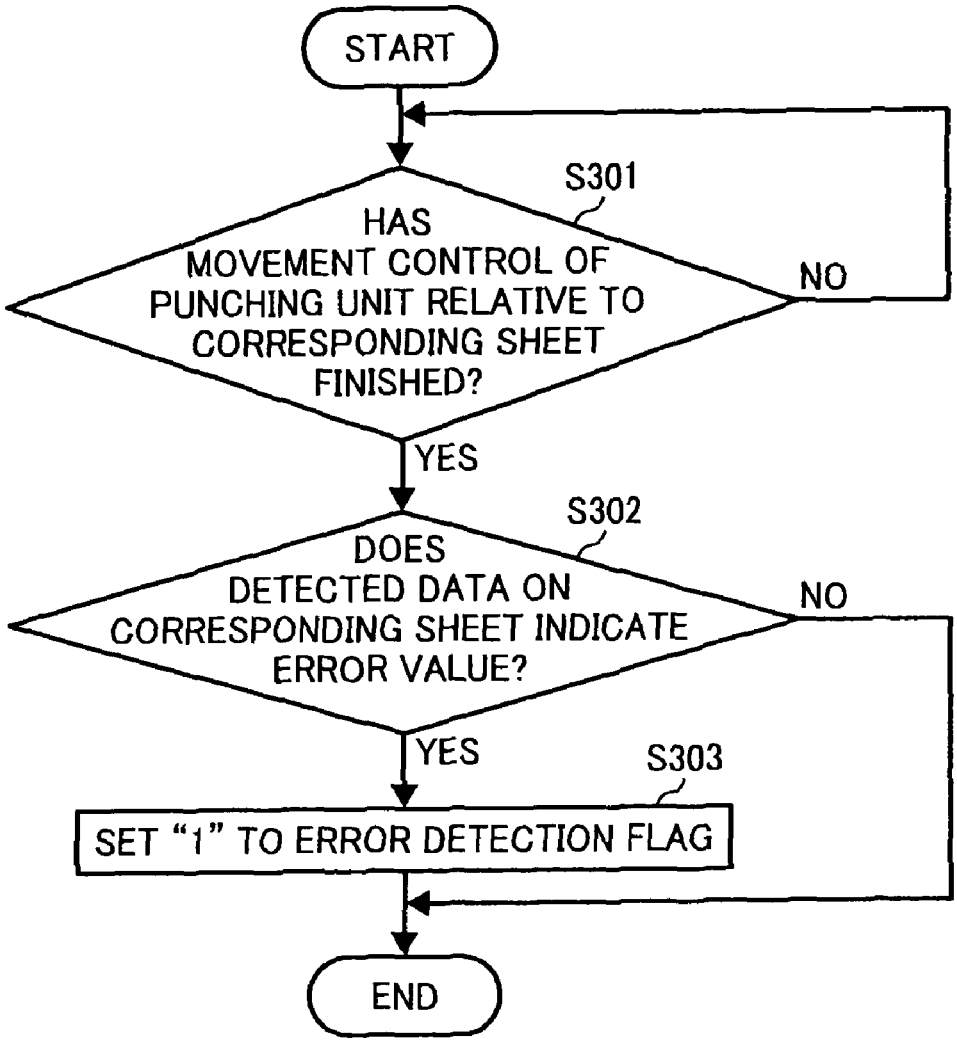
FIGS. 28A and 28B are flowcharts of a process of notifying an error.
Figure 28B:
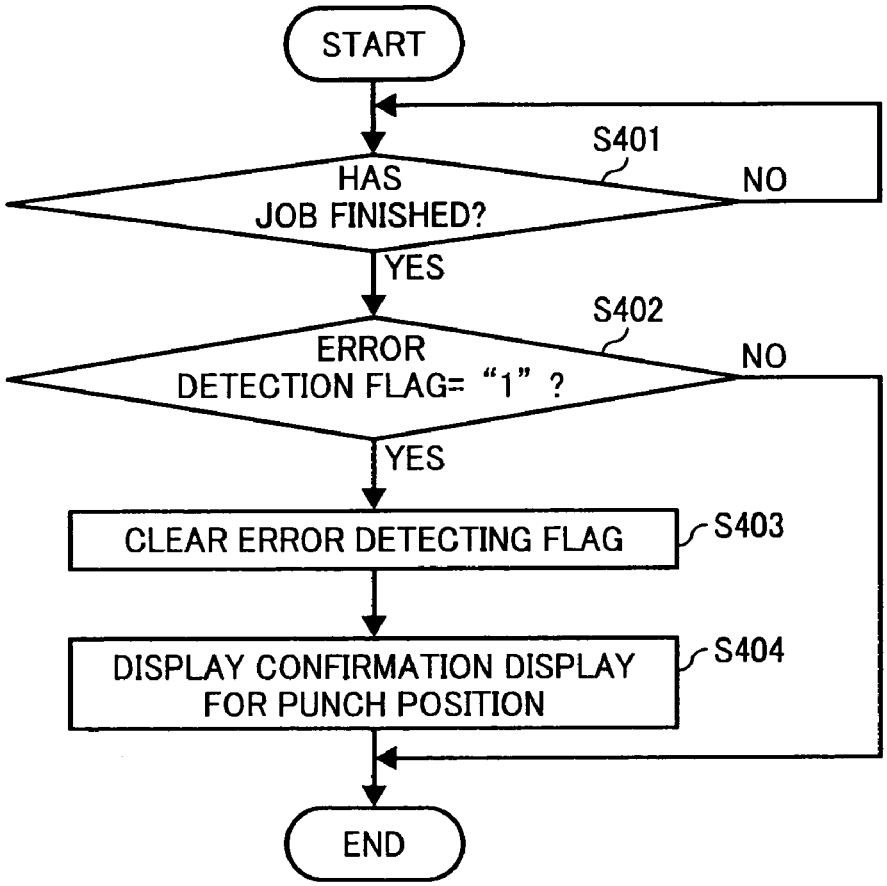

The above examples show the case where, when the sheet edge cannot be detected, the problem is handled using alternative data. In this case, although a possibility is low that an error has actually occurred, it is not possible to definitely determine that there is no possibility of error. Consequently, at step 206, the CPU (r) displays an message indicating that an error may have occurred. FIGS. 28A and 28B are flowcharts of specific examples of this process.

FIG. 28A is a flowchart of a process of operating an error detection flag. In FIG. 28A, the CPU (r) waits until the movement control of the punching unit 8 relative to the current sheet is finished (step S301) to determine whether the movement is based on an error value (step S302). When the movement is based on an error value, the CPU (r) sets "1" to the error detection flag (step S303).

Figure 29:
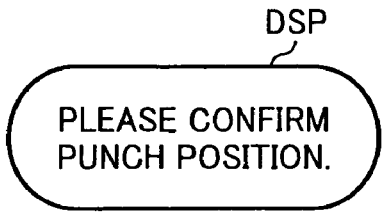
FIG. 29 is an example of an error message displayed in the control process shown in FIG. 27.

FIG. 28B is a flowchart of a process to control confirmation display. In FIG. 28B, the CPU (r) waits until the current job is finished (step S401). When "1" is set to the error detection flag after the job is finished (step S402), the CPU (r) clears the error detection flag (step S403). Thereafter, the CPU (r) displays on the display unit confirmation display so that the user can confirm the punch position (step S404). FIG. 29 is a view of a display example of the displaying device DSP serving as the display unit at step S404. In this example, a message "Please confirm punch position." is displayed on the displaying device DSP.

Such processing and display prevent missing the occurrence of a defective product, when the defective product may have occurred.

As set forth hereinabove, according to an embodiment of the present invention, even when a side edge position of the sheet cannot be detected, it is possible to continue the work without stopping the apparatus to a maximum extent to improve the usability and a processing efficiency.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A punching device comprising:

a conveying unit that conveys a recording medium;

a detecting unit that detects a lateral edge position of the recording medium to obtain edge position data;

a punching unit that punches the recording medium;

a moving unit that moves the punching unit in a direction perpendicular to a conveying direction in which the recording medium is conveyed;

a storage unit that stores therein edge position data obtained by the detecting unit as reference data; and a controlling unit that determines, 1) an average of detected edge position data, 2) calculates an amount of registration misalignment, and 3) determines a movement amount of the punching unit based on the reference data stored in the storage unit and the amount of misalignment, when the edge position data obtained from the recording medium by the detecting unit indicates an error value.

2. The punching device according to claim 1, wherein the controlling unit further determines the movement amount of the punching unit based on the average of the reference data.

3. The punching device according to claim 1, wherein the storage unit stores therein edge position data obtained by the detecting unit with respect to each size of recording medium as reference data, and the controlling unit determines the movement amount based on the average of reference data corresponding to a size of the recording medium.

4. The punching device according to claim 1, wherein the reference data is obtained from a job before detection of the error value, and the controlling unit determines the movement amount based on the average of the reference data.

5. The punching device according to claim 1, wherein the storage unit stores therein a default value with respect to each size of recording medium as default reference data, and the controlling unit determines, when the recording medium where the error value is detected is a first recording medium in a job, the movement amount based on default reference data corresponding to a size of the recording medium.

6. The punching device according to claim 1, wherein the storage unit accumulates therein edge position data obtained by the detecting unit with respect to each size of recording medium as further reference data, and the controlling unit determines, when the recording medium where the error value is detected is a first recording medium in a job and the further reference data corresponding to a size of the recording medium is present in the storage unit, the movement amount based on average of the reference data.

7. The punching device according to claim 6, wherein the storage unit stores therein a default value with respect to each size of recording medium as default reference data, and the controlling unit determines, when the further reference data corresponding to the size of the recording medium is not present in the storage unit, the movement amount based on default reference data corresponding to the size of the recording medium.

8. The punching device according to claim 1, wherein the storage unit accumulates therein edge position data obtained by the detecting unit with respect to each feed tray as additional reference data, and stores therein a default value with respect to each size of recording medium as default additional reference data, the controlling unit determines, when the additional reference data corresponding to a feed tray from which the recording medium has been fed is present in the storage unit, the movement amount based on average of the additional reference data, and the controlling unit determines, when the additional reference data corresponding to the feed tray is not present in the storage unit, the movement amount based on default reference data corresponding to a size of the recording medium.

9. The punching device according to claim 1, further comprising a notifying unit that notifies, when edge position data obtained by the detecting unit consecutively indicates an error value, that an error has occurred.

10. The punching device according to claim 1, wherein the controlling unit determines, when the edge position data obtained from the recording medium by the detecting unit indicates an error value, the movement amount based on data other than the edge position data in a job, the punching device further comprising:

a requesting unit that requests, when the detection result from the detecting unit is an error value, a user to confirm a punching position after the job is finished.

11. The punching device according to claim 1, wherein when the detecting unit cannot detect a lateral edge position of a recording medium and the detecting unit detects a misalignment larger than a threshold amount, the detecting unit detects the error value.

12. The punching device according to claim 11, wherein the threshold amount is determined based on a sum of a default value and a misalignment amount set with respect to each size of recording medium.

13. A finishing device comprising the punching device according to claim 1.

14. An image forming apparatus comprising:

a punching device including a conveying unit that conveys a recording medium;

a detecting unit that detects a lateral edge position of the recording medium to obtain edge position data;

a punching unit that punches the recording medium; and a moving unit that moves the punching unit in a direction perpendicular to a conveying direction in which the recording medium is conveyed;

a storage unit that stores therein edge position data obtained by the detecting unit as reference data; and a controlling unit that determines, 1) an average of previous position data, 2) calculates an amount of registration misalignment, and 3) determines a movement amount of the punching unit based on the reference data stored in the storage unit when the edge position data obtained from the recording medium by the detecting unit indicates an error value.

15. The image forming apparatus according to claim 14, wherein the punching device is provided for performing a predetermined finishing process on the recording medium.

16. The punching device according to claim 1, wherein the detecting unit is in a fixed position relative to the punching unit and the recording medium.

17. The punching device according to claim 1, further including an upper guide plate and a lower guide plate that receives the recording medium therebetween and the detecting unit is fixed to the upper guide plate.

* * * * *